US010621930B2

(12) United States Patent
Wu

(10) Patent No.: US 10,621,930 B2
(45) Date of Patent: Apr. 14, 2020

(54) IMAGE PROCESSING METHOD AND IMAGE PROCESSING DEVICE FOR REDUCING COLOR SHIFT

(71) Applicant: HIMAX TECHNOLOGIES LIMITED, Tainan (TW)

(72) Inventor: Tung-Ying Wu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 143 days.

(21) Appl. No.: 15/895,993

(22) Filed: Feb. 13, 2018

(65) Prior Publication Data

US 2019/0251916 A1 Aug. 15, 2019

(51) Int. Cl.

| | |
|---|---|
| ***G09G 5/10*** | (2006.01) |
| ***G09G 3/36*** | (2006.01) |
| ***G09G 3/20*** | (2006.01) |

(52) U.S. Cl.

CPC ..... *G09G 3/3607* (2013.01); *G09G 3/2003* (2013.01); *G09G 2320/0242* (2013.01); *G09G 2320/0271* (2013.01); *G09G 2320/0666* (2013.01); *G09G 2340/0457* (2013.01); *G09G 2340/06* (2013.01)

(58) Field of Classification Search

CPC ..... G09G 3/3607; G09G 3/2003

See application file for complete search history.

(56) References Cited

U.S. PATENT DOCUMENTS

| | | | | |
|---|---|---|---|---|
| 9,734,750 | B2 | 8/2017 | Chen | |
| 2004/0061711 | A1* | 4/2004 | Kurumisawa | G09G 3/3607 345/698 |
| 2006/0221030 | A1* | 10/2006 | Shih | G09G 3/3611 345/88 |
| 2011/0242149 | A1* | 10/2011 | Yoshida | G09G 3/3648 345/690 |
| 2011/0254759 | A1* | 10/2011 | Mori | G09G 3/3607 345/88 |
| 2011/0254879 | A1* | 10/2011 | Mori | G09G 3/3607 345/690 |
| 2013/0088528 | A1* | 4/2013 | Borgers | G09G 3/3648 345/690 |

(Continued)

FOREIGN PATENT DOCUMENTS

| | | |
|---|---|---|
| CN | 105184746 A | 12/2015 |
| CN | 105321485 A | 2/2016 |

(Continued)

*Primary Examiner* — Adam J Snyder

(74) *Attorney, Agent, or Firm* — CKC & Partners Co., LLC

(57) ABSTRACT

A method for processing an image includes the following steps. A data of the image including a first pixel and a second pixel adjacent to each other is provided. A first subpixel of the first pixel and a second subpixel of the second pixel are set as a higher subpixel and a lower subpixel. A lookup process is performed to determine a shifted gray level of the higher subpixel and a shifted gray level of the lower subpixel in accordance with the gray level of the higher subpixel and the gray level of the lower subpixel respectively. A gray level of the higher subpixel and a gray level of the lower subpixel are updated in accordance with the shifted gray level of the higher subpixel and the shifted gray level of the lower subpixel.

32 Claims, 18 Drawing Sheets

(56) References Cited

U.S. PATENT DOCUMENTS

| | | | | |
|---|---|---|---|---|
| 2014/0232741 | A1* | 8/2014 | Choi | G09G 5/028 345/600 |
| 2014/0285511 | A1 | 9/2014 | Hoshino | |
| 2016/0267874 | A1* | 9/2016 | Chen | G09G 5/02 |

FOREIGN PATENT DOCUMENTS

| | | | |
|---|---|---|---|
| CN | 105374018 | A | 3/2016 |
| TW | I537873 | B | 6/2016 |

* cited by examiner

| | | | |
|---|---|---|---|
| R (H1) | R (L1) | R (H1) | R (L1) |
| G (L1) | G (H1) | G (L1) | G (H1) |
| B (H1) | B (L1) | B (H1) | B (L1) |
| R (L2) | R (H2) | R (L2) | R (H2) |
| G (H2) | G (L2) | G (H2) | G (L2) |
| B (L2) | B (H2) | B (L2) | B (H2) |

. . .

⋮

FIG. 6d

IMAGE PROCESSING METHOD AND IMAGE PROCESSING DEVICE FOR REDUCING COLOR SHIFT

BACKGROUND

Field of Invention

The present invention relates to a method and a device for processing an image. More particularly, the present invention relates to a method and a device for reducing color shift when displayed on a display.

Description of Related Art

Liquid crystal displays (LCDs), characterized in low radiation, small size and low power consumption, have gradually replaced traditional cathode ray tube (CRT) devices and become the mainstream display. However, the deviation of the display effects when viewed directly in front and viewed at an angle is known as "color shift".

The so-called 2D1G technology is one of the techniques to reduce color shift at present. Each of the subpixels is divided into a primary pixel area and a secondary pixel area. The primary pixel area and the secondary pixel area are connected to different data lines and a same scan line. The primary pixel area and the secondary pixel area are inputted different data signals to have different gray levels, thus resulting in different brightness when viewed directly in front and viewed at an angle, thereby reducing the color shift problems. However, for each of the subpixels, the number of the data lines is doubled, thus greatly reducing the aperture ratio of the LCD.

SUMMARY

In the invention, a method and a device for processing an image are provided. In the method, a gray level of each of the subpixels is corrected, so as to converge to a standard gamma curve using a gamma value of 2.2, thereby reducing color shift when displayed on a display.

One aspect of the invention is directed to a method for processing an image. The method includes the following steps. A data of the image is provided. The image includes a first pixel and a second pixel adjacent to each other. Each of the first pixel and the second pixel has plural subpixels. The data includes a gray level of each of the subpixels. A first subpixel of the subpixels of the first pixel and a second subpixel of the pixels of the second pixel are set as a higher subpixel and a lower subpixel. The color of the first subpixel is the same as the color of the second subpixel. A lookup process is performed to determine a shifted gray level of the higher subpixel and a shifted gray level of the lower subpixel in accordance with the gray level of the higher subpixel and the gray level of the lower subpixel respectively. The shifted gray level of the higher subpixel is greater than the shifted gray level of the lower subpixel. The gray level of the first subpixel and the gray level of the second subpixel are updated in accordance with the shifted gray level of the higher subpixel and the shifted gray level of the lower subpixel.

In accordance with one or more embodiments of the invention, the method further includes the following steps. An edge detection is performed on the first subpixel and on the second subpixel respectively to determine whether an edge is presented. The shifted gray level of the higher subpixel is decreased to obtain a decreased shifted gray level, and the shifted gray level of the lower subpixel is increased to obtain an increased shifted gray level, if the edge is presented. The shifted gray level of the higher subpixel and the shifted gray level of the lower subpixel are replaced with the decreased shifted gray level and the increased shifted gray level, respectively, before updating the gray level of the first subpixel and the gray level of the second subpixel, if the edge is presented.

In accordance with one or more embodiments of the invention, each of the first pixel and the second pixel has plural neighboring pixels. Each of the neighboring pixels has plural subpixels. The neighboring pixels of the first pixel do not include the other pixels positioned in a next row of the first pixel. The neighboring pixels of the second pixel do not include the other pixels positioned in the next row of the second pixel. The edge detection is performed on the first subpixel and on the second subpixel respectively to determine whether the edge is presented includes the following steps. A gray level difference of the first subpixel which is a difference between the gray level of the first subpixel and a gray level of a third subpixel of the subpixels of the neighboring pixels of the first subpixel is calculated. The color of the third subpixel is the same as the color of the first subpixel. A gray level difference of the second subpixel which is the difference between the gray level of the second subpixel and a gray level of a fourth subpixel of the subpixels of the neighboring pixels of the second pixel is calculated. The color of the fourth subpixel is the same as the color of the second subpixel. The edge is determined to be presented if either a greatest value of the gray level differences of the first subpixel is larger than or equal to an edge threshold or a greatest value of the gray level differences of the second subpixel is larger than or equal to the edge threshold.

In accordance with one or more embodiments of the invention, setting the first subpixel and the second subpixel as the higher subpixel and the lower subpixel includes the following steps. A gray level difference which is a difference between the gray level of the first subpixel and the gray level of the second subpixel is calculated. The first subpixel and the second subpixel are determined as the higher subpixel and the lower subpixel if either the gray level difference is less than a difference threshold or the gray level of the first subpixel is greater than or equal to the gray level of the second subpixel. The first subpixel and the second subpixel are determined as the lower subpixel and the higher subpixel if the gray level difference is greater than or equal to the difference threshold and the gray level of the first subpixel is less than the gray level of the second subpixel.

In accordance with one or more embodiments of the invention, a formula of decreasing the shifted gray level of the higher subpixel to obtain the decreased shifted gray level is as follows:

$$\text{decreased shifted gray level} = SGLH - \text{ROUND}\left(\frac{(SGLH - GLH) \times LUT(MAXH)}{1024}\right)$$

A function of "ROUND" means to round up to a nearest integer. A function of "LUT" means to perform the lookup process. An input of "SGLH" means the shifted gray level of the higher subpixel. An input of "GLH" means the gray level of the higher subpixel. A higher pixel including the higher subpixel has plural neighboring pixels. Each of the neighboring pixels has plural subpixels. The neighboring pixels of the higher pixel do not include the other pixels positioned in a next row of the higher pixel. An input of "MAXH" means a greatest value of the gray levels of the higher subpixel and each of a gray level of a fifth subpixel of the subpixels of the neighboring pixels of the higher pixel. The color of the fifth subpixel is the same as the color of the higher subpixel.

In accordance with one or more embodiments of the invention, a formula of increasing the shifted gray level of the lower subpixel to obtain the increased shifted gray level is as follows:

$$\text{increased shifted gray level} = SGLL + \text{ROUND}\left(\frac{(GLL - SGLL) \times LUT(MAXL)}{1024}\right)$$

A function of "ROUND" means to round up to a nearest integer. A function of "LUT" means to perform the lookup process. An input of "SGLL" means the shifted gray level of the lower subpixel. An input of "GLL" means the gray level of the lower subpixel. A lower pixel including the lower subpixel has plural neighboring pixels. Each of the neighboring pixels has plural subpixels. The neighboring pixels of the lower pixel do not include the other pixels positioned in a next row of the lower pixel. An input of "MAXL" means a greatest value of the gray levels of the lower subpixel and each of a gray level of a sixth subpixel of the subpixels of the neighboring pixels of the lower pixel. The color of the sixth subpixel is the same as the color of the lower subpixel.

In accordance with one or more embodiments of the invention, the method further includes a following step. A color conversion is performed to obtain plural color values of the first pixel and plural color values of the second pixel in accordance with the gray levels of the subpixels of the first pixel and the gray levels of the subpixels of the second pixel respectively. A color lookup process is performed to determine a corrected gain of the first subpixel and a corrected gain of the second subpixel in accordance with the color values of the first pixel and the color values of the second pixel respectively. The gray level of the first subpixel is multiplied by the corrected gain of the first subpixel, and the gray level of the second subpixel is multiplied by the corrected gain of the second subpixel, before performing the lookup process.

In accordance with one or more embodiments of the invention, each of the first subpixel and the second subpixel is one of a red subpixel, a green subpixel, and a blue subpixel.

In accordance with one or more embodiments of the invention, each of the first subpixel and the second subpixel is one of a red subpixel, a green subpixel, a blue subpixel, and a white subpixel.

In accordance with one or more embodiments of the invention, the color conversion is an RGB-to-HSV conversion or an RGB-to-HSL conversion.

In accordance with one or more embodiments of the invention, the method further includes a following step: an RGB-to-RGBW conversion is performed before setting the first subpixel and the second subpixel.

Another aspect of the invention is directed to a device for processing an image. The device includes a receiving unit, a setting unit, a lookup unit, and an updating unit. The receiving unit is configured to receive a data of the image. The image includes a first pixel and a second pixel adjacent to each other. Each of the first pixel and the second pixel has plural subpixels. The data includes a gray level of each of the subpixels. The setting unit is configured to set a first subpixel of the subpixels of the first pixel and a second subpixel of the pixels of the second pixel as a higher subpixel and a lower subpixel. The color of the first subpixel is the same as the color of the second subpixel. The lookup unit is configured to perform a lookup process to determine a shifted gray level of the higher subpixel and a shifted gray level of the lower subpixel in accordance with the gray level of the higher subpixel and the gray level of the lower subpixel respectively. The shifted gray level of the higher subpixel is greater than the shifted gray level of the lower subpixel. The updating unit is configured to update the gray level of the first subpixel and the gray level of the second subpixel in accordance with the shifted gray level of the higher subpixel and the shifted gray level of the lower subpixel.

In accordance with one or more embodiments of the invention, the device further includes an edge detection unit and an edge correction unit. The edge detection unit is configured to perform an edge detection on the first subpixel and on the second subpixel respectively to determine whether an edge is presented. The edge correction unit is configured to decrease the shifted gray level of the higher subpixel obtain a decreased shifted gray level, and to increase the shifted gray level of the lower subpixel to obtain an increased shifted gray level, and to replace the shifted gray level of the higher subpixel and the shifted gray level of the lower subpixel with the decreased shifted gray level and the increased shifted gray level, respectively, before updating the gray level of the first subpixel and the gray level of the second subpixel, if the edge is presented.

In accordance with one or more embodiments of the invention, each of the first pixel and the second pixel has plural neighboring pixels. Each of the neighboring pixels has plural subpixels. The neighboring pixels of the first pixel do not include the other pixels positioned in a next row of the first pixel. The neighboring pixels of the second pixel do not include the other pixels positioned in the next row of the second pixel. The edge detection is performed on the first subpixel and on the second subpixel respectively to determine whether the edge is presented includes the following steps. A gray level difference of the first subpixel which is a difference between the gray level of the first subpixel and a gray level of a third subpixel of the subpixels of the neighboring pixels of the first subpixel is calculated. The color of the third subpixel is the same as the color of the first subpixel. A gray level difference of the second subpixel which is the difference between the gray level of the second subpixel and a gray level of a fourth subpixel of the subpixels of the neighboring pixels of the second pixel is calculated. The color of the fourth subpixel is the same as the color of the second subpixel. The edge is determined to be presented if either a greatest value of the gray level differences of the first subpixel is larger than or equal to an edge threshold or a greatest value of the gray level differences of the second subpixel is larger than or equal to the edge threshold.

In accordance with one or more embodiments of the invention, the setting unit is configured to perform the following steps. A gray level difference which is a difference between the gray level of the first subpixel and the gray level of the second subpixel is calculated. The first subpixel and the second subpixel are determined as the higher subpixel and the lower subpixel if either the gray level difference is less than a difference threshold or the gray level of the first subpixel is greater than or equal to the gray level of the second subpixel. The first subpixel and the second subpixel are determined as the lower subpixel and the higher subpixel if the gray level difference is greater than or equal to the difference threshold and the gray level of the first subpixel is less than the gray level of the second subpixel.

In accordance with one or more embodiments of the invention, a formula of decreasing the shifted gray level of the higher subpixel to obtain the decreased shifted gray level is as follows:

$$\text{decreased shifted gray level} = SGLH - \text{ROUND}\left(\frac{(SGLH - GLH) \times LUT(MAXH)}{1024}\right)$$

A function of "ROUND" means to round up to a nearest integer. A function of "LUT" means to perform the lookup process. An input of "SGLH" means the shifted gray level of the higher subpixel. An input of "GLH" means the gray level of the higher subpixel. A higher pixel including the higher subpixel has plural neighboring pixels. Each of the neighboring pixels has plural subpixels. The neighboring pixels of the higher pixel do not include the other pixels positioned in a next row of the higher pixel. An input of "MAXH" means a greatest value of the gray levels of the higher subpixel and each of a gray level of a fifth subpixel of the subpixels of the neighboring pixels of the higher pixel. The color of the fifth subpixel is the same as the color of the higher subpixel.

In accordance with one or more embodiments of the invention, a formula of increasing the shifted gray level of the lower subpixel to obtain the increased shifted gray level is as follows:

$$\text{increased shifted gray level} = SGLL + \text{ROUND}\left(\frac{(GLL - SGLL) \times LUT(MAXL)}{1024}\right)$$

A function of "ROUND" means to round up to a nearest integer. A function of "LUT" means to perform the lookup process. An input of "SGLL" means the shifted gray level of the lower subpixel. An input of "GLL" means the gray level of the lower subpixel. A lower pixel including the lower subpixel has plural neighboring pixels. Each of the neighboring pixels has plural subpixels. The neighboring pixels of the lower pixel do not include the other pixels positioned in a next row of the lower pixel. An input of "MAXL" means a greatest value of the gray levels of the lower subpixel and each of a gray level of a sixth subpixel of the subpixels of the neighboring pixels of the lower pixel. The color of the sixth subpixel is the same as the color of the lower subpixel.

In accordance with one or more embodiments of the invention, the device further includes a color conversion unit and a color lookup unit. The color conversion unit is configured to perform a color conversion to obtain plural color values of the first pixel and plural color values of the second pixel in accordance with the gray levels of the subpixels of the first pixel and the gray levels of the subpixels of the second pixel respectively. The color lookup unit is configured to perform a color lookup process to determine a corrected gain of the first subpixel and a corrected gain of the second subpixel in accordance with the color values of the first pixel and the color values of the second pixel respectively. The updating unit is further configured to multiply the gray level of the first subpixel by the corrected gain of the first subpixel and to multiply the gray level of the second subpixel by the corrected gain of the second subpixel, before performing the lookup process.

In accordance with one or more embodiments of the invention, each of the first subpixel and the second subpixel is one of a red subpixel, a green subpixel, and a blue subpixel.

In accordance with one or more embodiments of the invention, each of the first subpixel and the second subpixel is one of a red subpixel, a green subpixel, a blue subpixel, and a white subpixel.

In accordance with one or more embodiments of the invention, the color conversion is an RGB-to-HSV conversion or an RGB-to-HSL conversion.

In accordance with one or more embodiments of the invention, the device further includes an RGB-to-RGBW conversion unit configured to perform an RGB-to-RGBW conversion before setting the first subpixel and the second subpixel.

Another aspect of the invention is directed to a method for processing an image. The method includes the following steps. A data of the image is provided. The image includes plural pixels, and each of the pixels has plural subpixels. The data includes a gray level of each of the subpixels. The pixels include a first pixel and a second pixel positioned at a first column in sequence. The pixels further include a third pixel and a fourth pixel positioned at a second column in sequence. The first column is adjacent to the second column. The first pixel is adjacent to the third pixel. A first subpixel of the subpixels of the first pixel, a second subpixel of the subpixels of the second pixel, a third subpixel of the subpixels of the third pixel, and a fourth subpixel of the subpixels of the fourth pixel are set as a first higher subpixel, a first lower subpixel, a second higher subpixel, and a second lower subpixel. The first subpixel, the second subpixel, the third subpixel, and the fourth subpixel have the same color. A lookup process is performed to determine a shifted gray level of the first higher subpixel and a shifted gray level of the first lower subpixel in accordance with the gray level of the first higher subpixel and the gray level of the first lower subpixel, respectively. A recovery process is performed to determine a shifted gray level of the second higher subpixel and a shifted gray level of the second lower subpixel in accordance with the shifted gray level of the first higher subpixel and the shifted gray level of the first lower subpixel, respectively. The gray level of the first subpixel, the gray level of the second subpixel, the gray level of the third subpixel, and the gray level of the fourth subpixel are updated in accordance with the shifted gray level of the first subpixel, the shifted gray level of the second subpixel, the shifted gray level of the third subpixel, and the shifted gray level of the fourth subpixel, respectively.

In accordance with one or more embodiments of the invention, the recovery process includes the following steps. A recovery lookup process is performed to determine a second higher gain value and a second lower gain value in accordance with the shifted gray level of the first higher subpixel and the shifted gray level of the first lower subpixel, respectively. The shifted gray level of the first higher subpixel is multiplied by the second higher gain value to determine the shifted gray level of the second higher subpixel. The shifted gray level of the first lower subpixel is multiplied by the second lower gain value to determine the shifted gray level of the second lower subpixel.

In accordance with one or more embodiments of the invention, the recovery process includes the following steps. A recovery lookup process is performed to determine a second higher difference value and a second lower difference value in accordance with the shifted gray level of the first higher subpixel and the shifted gray level of the first lower subpixel, respectively. The second higher difference value is added to the shifted gray level of the first higher subpixel to determine the shifted gray level of the second higher subpixel. The second lower difference value is added to the shifted gray level of the first lower subpixel to determine the shifted gray level of the second lower subpixel.

In accordance with one or more embodiments of the invention, setting the first subpixel, the second subpixel, the third subpixel, and the fourth subpixel as the first higher subpixel, the first lower subpixel, the second higher subpixel, and the second lower subpixel includes the following steps. The first subpixel is set as the first higher subpixel. The second subpixel is set as the first lower subpixel. The third subpixel is set as the second lower subpixel. The fourth subpixel is set as the second higher subpixel.

In accordance with one or more embodiments of the invention, setting the first subpixel, the second subpixel, the third subpixel, and the fourth subpixel as the first higher subpixel, the first lower subpixel, the second higher subpixel, and the second lower subpixel includes the following steps. The first subpixel is set as the first lower subpixel. The second subpixel is set as the first higher subpixel. The third subpixel is set as the second higher subpixel. The fourth subpixel is set as the second lower subpixel.

In accordance with one or more embodiments of the invention, each of the first subpixel, the second subpixel, the third subpixel, and the fourth subpixel is one of a red subpixel, a green subpixel, and a blue subpixel.

Another aspect of the invention is directed to a device for processing an image. The device includes a receiving unit, a setting unit, a lookup unit, a recovery lookup unit, and an updating unit. The receiving unit is configured to receive a data of the image. The image includes plural pixels, and each of the pixels has plural subpixels. The data includes a gray level of each of the subpixels. The pixels include a first pixel and a second pixel positioned at a first column in sequence. The pixels further include a third pixel and a fourth pixel positioned at a second column in sequence. The first column is adjacent to the second column. The first pixel is adjacent to the third pixel. The setting unit is configured to set a first subpixel of the subpixels of the first pixel, a second subpixel of the subpixels of the second pixel, a third subpixel of the subpixels of the third pixel, and a fourth subpixel of the subpixels of the fourth pixel as a first higher subpixel, a first lower subpixel, a second higher subpixel, and a second lower subpixel. The first subpixel, the second subpixel, the third subpixel, and the fourth subpixel have the same color. The lookup unit is configured to perform a lookup process to determine a shifted gray level of the first higher subpixel and a shifted gray level of the first lower subpixel in accordance with the gray level of the first higher subpixel and the gray level of the first lower subpixel, respectively. The recovery lookup unit is configured to perform a recovery process to determine a shifted gray level of the second higher subpixel and a shifted gray level of the second lower subpixel in accordance with the shifted gray level of the first higher subpixel and the shifted gray level of the first lower subpixel, respectively. The updating unit is configured to update the gray level of the first subpixel, the gray level of the second subpixel, the gray level of the third subpixel, and the gray level of the fourth subpixel in accordance with the shifted gray level of the first subpixel, the shifted gray level of the second subpixel, the shifted gray level of the third subpixel, and the shifted gray level of the fourth subpixel, respectively.

In accordance with one or more embodiments of the invention, the recovery process includes the following steps. A recovery lookup process is performed to determine a second higher gain value and a second lower gain value in accordance with the shifted gray level of the first higher subpixel and the shifted gray level of the first lower subpixel, respectively. The shifted gray level of the first higher subpixel is multiplied by the second higher gain value to determine the shifted gray level of the second higher subpixel. The shifted gray level of the first lower subpixel is multiplied by the second lower gain value to determine the shifted gray level of the second lower subpixel.

In accordance with one or more embodiments of the invention, the recovery process includes the following steps. A recovery lookup process is performed to determine a second higher difference value and a second lower difference value in accordance with the shifted gray level of the first higher subpixel and the shifted gray level of the first lower subpixel, respectively. The second higher difference value is added to the shifted gray level of the first higher subpixel to determine the shifted gray level of the second higher subpixel. The second lower difference value is added to the shifted gray level of the first lower subpixel to determine the shifted gray level of the second lower subpixel.

In accordance with one or more embodiments of the invention, setting the first subpixel, the second subpixel, the third subpixel, and the fourth subpixel as the first higher subpixel, the first lower subpixel, the second higher subpixel, and the second lower subpixel includes the following steps. The first subpixel is set as the first higher subpixel. The second subpixel is set as the first lower subpixel. The third subpixel is set as the second lower subpixel. The fourth subpixel is set as the second higher subpixel.

In accordance with one or more embodiments of the invention, setting the first subpixel, the second subpixel, the third subpixel, and the fourth subpixel as the first higher subpixel, the first lower subpixel, the second higher subpixel, and the second lower subpixel includes the following steps. The first subpixel is set as the first lower subpixel. The second subpixel is set as the first higher subpixel. The third subpixel is set as the second higher subpixel. The fourth subpixel is set as the second lower subpixel.

In accordance with one or more embodiments of the invention, each of the first subpixel, the second subpixel, the third subpixel, and the fourth subpixel is one of a red subpixel, a green subpixel, and a blue subpixel.

BRIEF DESCRIPTION OF THE DRAWINGS

The invention can be more fully understood by reading the following detailed description of the embodiment, with reference made to the accompanying drawings as follows:

FIG. 6*d* is a schematic diagram showing a subpixel tri-gate arrangement of the image according to an embodiment of the present invention.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size.

It will be understood that, although the terms "first," "second," and "third" may be used herein to describe various elements, components, areas, layers and/or regions, these elements, components, areas, layers and/or regions, should not be limited by these terms. These terms are only used to distinguish elements, components, areas, layers and/or regions.

Figure 1A:
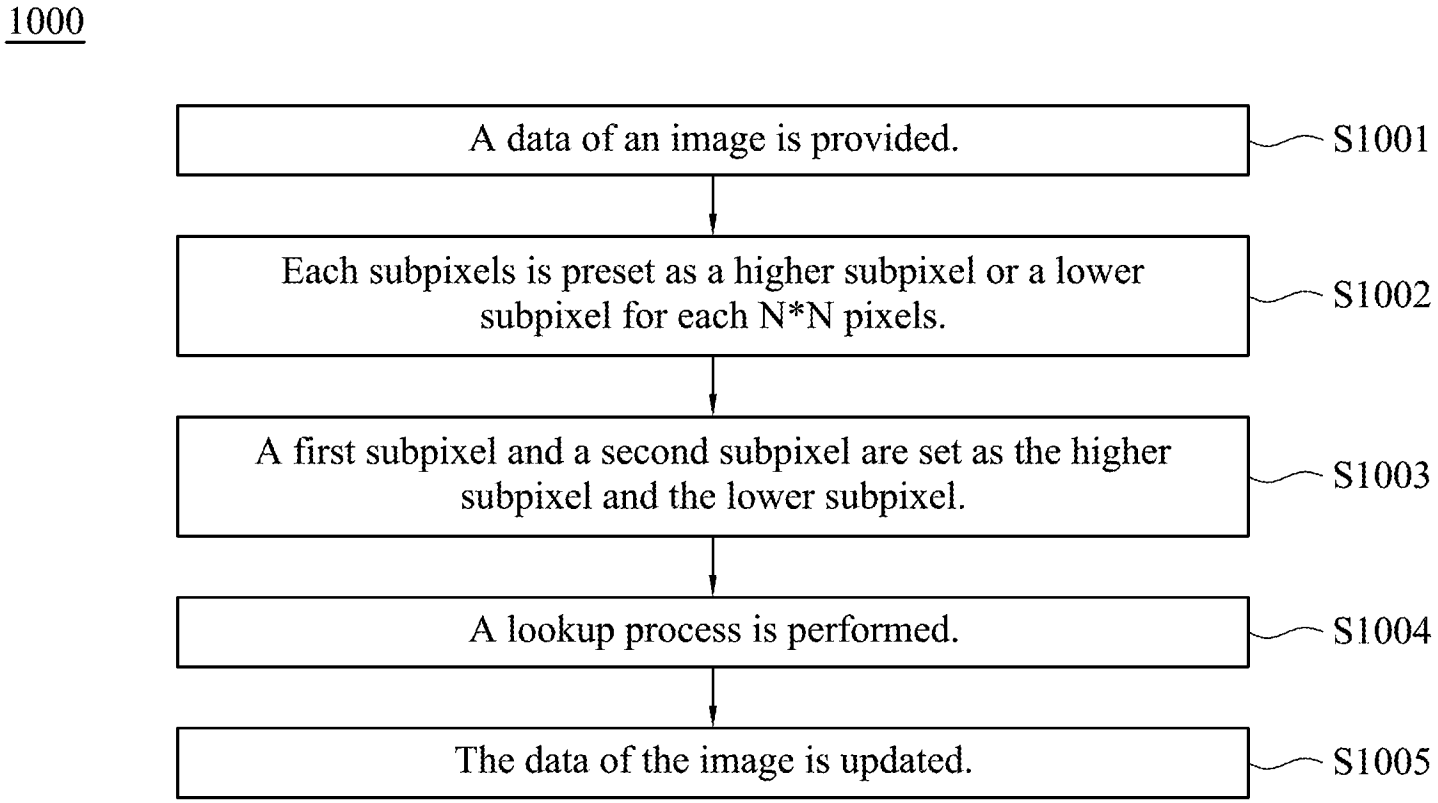
FIG. 1*a* is a flow chart showing a method for processing an image according to a first embodiment of the present invention.

FIG. 1*a* is a flow chart showing a method 1000 for processing an image 10 according to a first embodiment of the present invention. FIG. 1*c* is a schematic diagram showing a subpixel arrangement of the image 10 according to the first embodiment of the present invention. The method 1000 includes the plural steps S1001-S1005. In step S1001, as shown in FIG. 1*a*, a data of the image 10 is provided. The image 10 includes plural pixels 11, 21, 31, 12, 22, 32, 13, 23, 33, etc. Each of the pixels of the image 10 includes three subpixels, i.e., a red subpixel, a green subpixel, and a blue subpixel. For example, the pixel 22 includes the red subpixel 221, the green subpixel 222, and the blue subpixel 223, and so on. In addition, the data of the image 10 includes a gray level of each of the subpixels of each of the pixels of the image 10.

In step S1002, as shown in FIG. 1*a*, each subpixels of each of the pixels of the image 10 is preset as a higher subpixel or a lower subpixel for each of N*N pixels. In the first embodiment of the present invention, N=4.

In step S1003, as shown in FIG. 1*a*, a first subpixel and a second subpixel are set as a higher subpixel and a lower subpixel. It is noted that the color of the first subpixel is the same as the color of the second subpixel. It is noted that the setting of the first subpixel and the second subpixel is performed on the subpixels with the red color, the blue color and the green color respectively. In the followings, the red subpixels of the pixels are taken as an example to illustrate the setting of the first subpixel and the second subpixel. Referring to FIG. 1*c*, in this embodiment, the red subpixel 221 of the pixel 22 is taken as the first subpixel, and the red subpixel 231 of the pixel 23 adjacent to the pixel 22 is taken as the second subpixel. An operation of setting of the first subpixel (i.e., the red subpixel 221) and the second subpixel (i.e., the red subpixel 231) as the higher subpixel and the lower subpixel is described as follows.

First, a gray level difference is calculated, in which the gray level difference is a difference between the gray level of the first subpixel (i.e., the red subpixel 221) and the gray level of the second subpixel (i.e., the red subpixel 231). Next, the first subpixel (i.e., the red subpixel 221) and the second subpixel (i.e., the red subpixel 231) are respectively determined as the higher subpixel and the lower subpixel if either the gray level difference is less than a difference threshold or the gray level of the first subpixel (i.e., the red subpixel 221) is greater than or equal to the gray level of the second subpixel (i.e., the red subpixel 231). In contrast, the first subpixel (i.e., the red subpixel 221) and the second subpixel (i.e., the red subpixel 231) are respectively determined as the lower subpixel and the higher subpixel if the gray level difference is greater than or equal to the difference threshold and the gray level of the first subpixel (i.e., the red subpixel 221) is less than the gray level of the second subpixel (i.e., the red subpixel 231). It is noted that the difference threshold may be determined by a manufacturer.

In step S1004, as shown in FIG. 1*a*, a lookup process is performed on the higher subpixel and the lower subpixel. It is noted that the color of the higher subpixel is the same as the color of the lower subpixel. It is noted that the lookup process is performed on the subpixels with the red color, the blue color and the green color respectively. An operation of performing the lookup process on the higher subpixel and the lower subpixel is described as follows. A shifted gray level of the higher subpixel is determined according to a higher lookup table (H_LUT) based on a gray level of the higher subpixel, and a shifted gray level of the lower subpixel is determined according to a lower lookup table (L_LUT) based on a gray level of the lower subpixel. It is noted that the H_LUT and the L_LUT may be associated with the test pattern data. It is noted that the lookup process is configured to let the gray levels of the higher subpixel and the lower subpixel to be converged to a standard gamma curve using a gamma value of 2.2, thereby reducing color shift when displaying the image on a RGB display.

In step S1005, as shown in FIG. 1*a*, the data of the image 10 is updated. The data of the image 10 is updated by replacing the gray level of the higher subpixel with the shifted gray level of the higher subpixel, and replacing the gray level of the lower subpixel with the shifted gray level of the lower subpixel. It is noted that the color of the higher subpixel is the same as the color of the lower subpixel. It is noted that all the subpixels of the pixels of the image 10 are processed by the steps S1002-S1005.

Figure 1B:
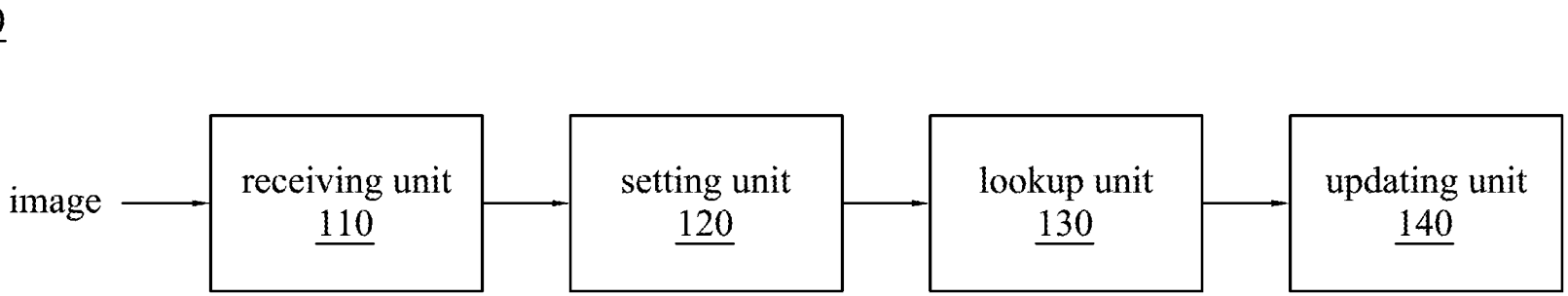
FIG. 1*b* is a block diagram showing a device for processing the image according to the first embodiment of the present invention.
Figure 1C:
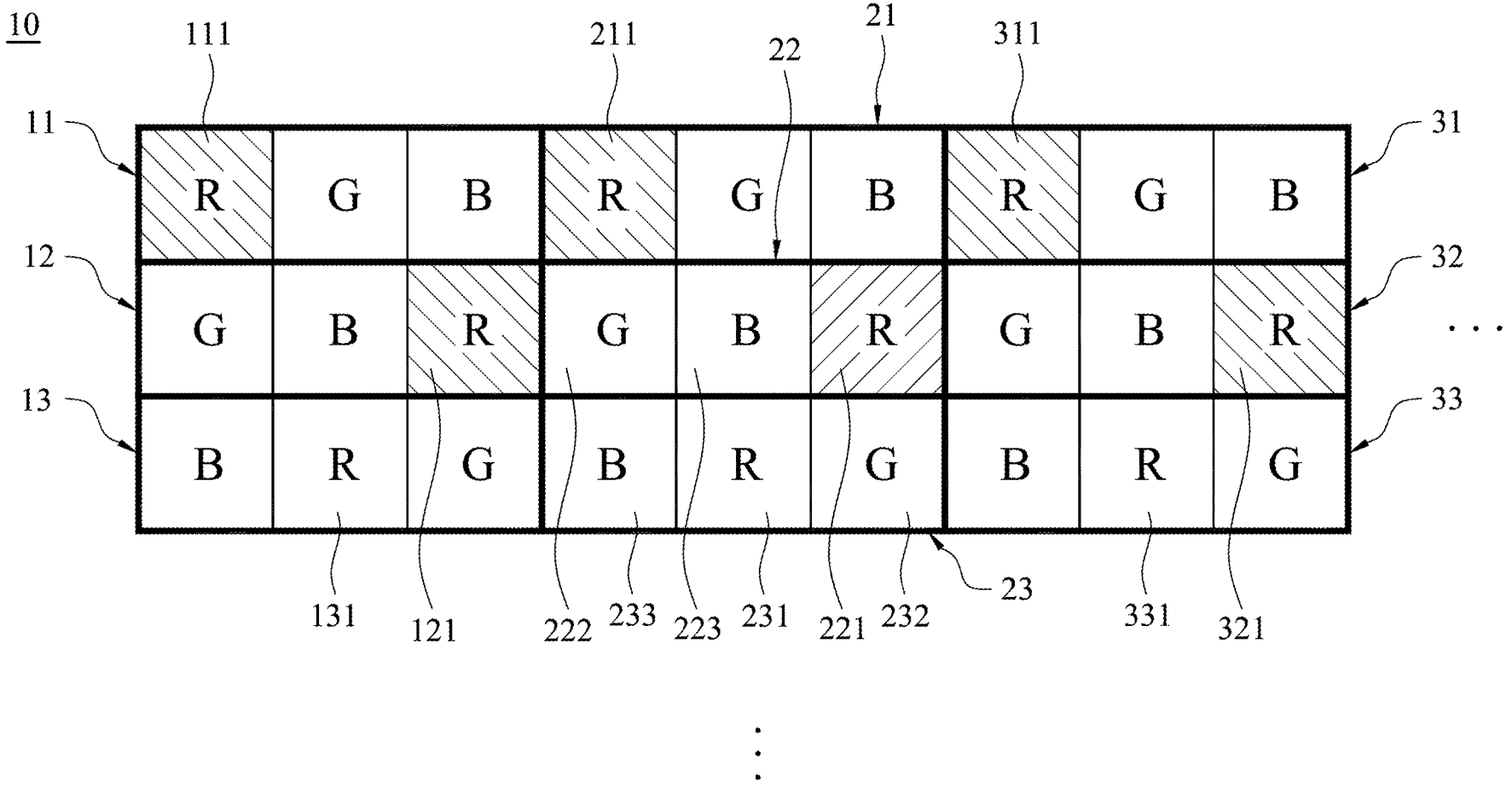
FIG. 1*c* is a schematic diagram showing a subpixel arrangement of the image according to the first embodiment of the present invention.

FIG. 1*b* is a block diagram showing a device 100 for processing the image 10 according to the first embodiment of the present invention. The device 100 includes a receiving unit 110, a setting unit 120, a lookup unit 130, and an updating unit 140. The receiving unit 110 is configured to receive the data of the image 10. The setting unit 120 is configured to perform the steps S1002 and S1003 of the method 1000. The lookup unit 130 is configured to perform the step S1004 of the method 1000. The updating unit 140 is configured to perform the step S1005 of the method 1000.

Figure 2A:
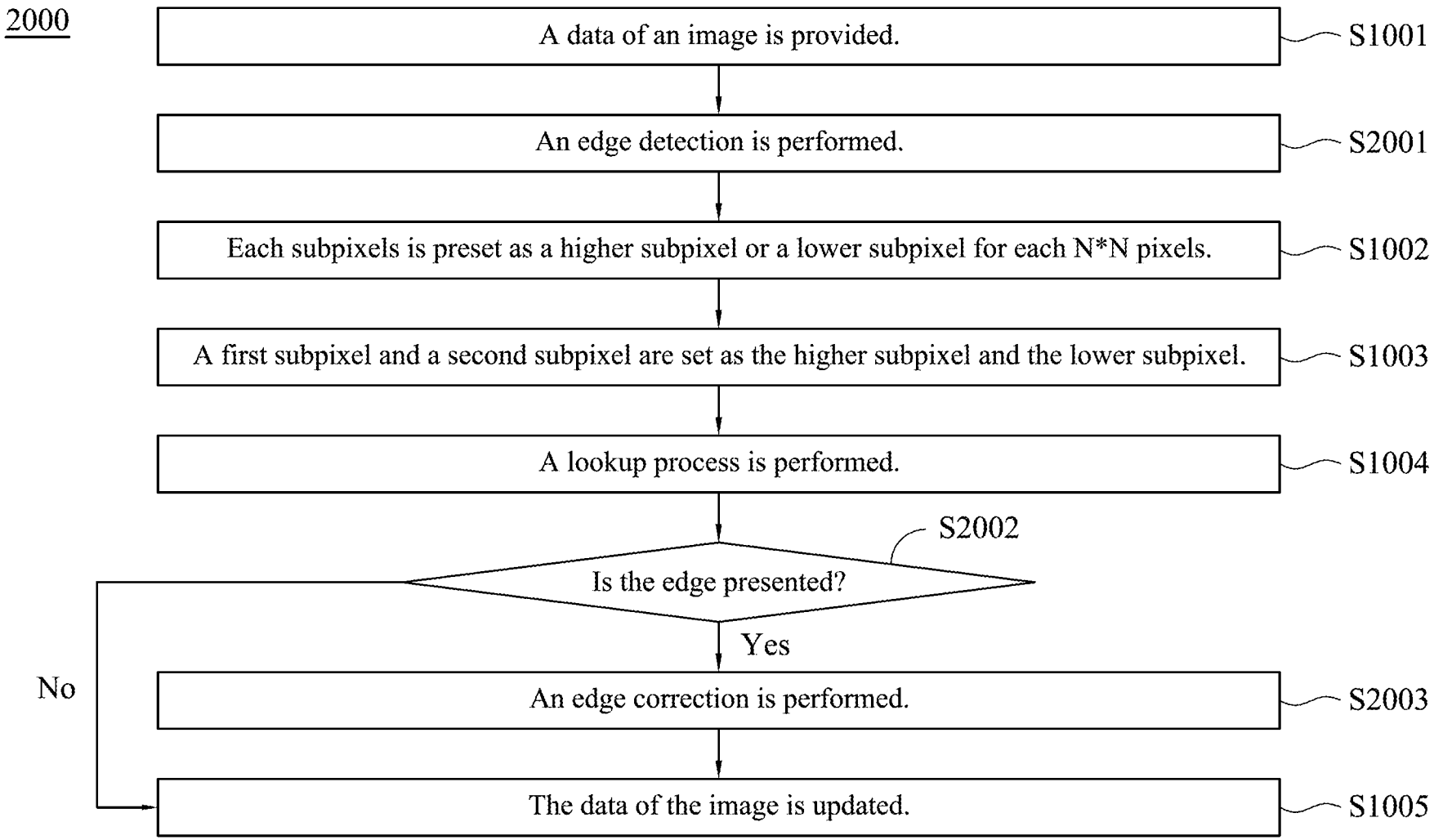
FIG. 2*a* is a flow chart showing a method for processing the image according to a second embodiment of the present invention.

FIG. 2*a* is a flow chart showing a method 2000 for processing the image 10 according to a second embodiment of the present invention. The method 2000 is similar to the method 1000 except plural steps S2001-S2003 are inserted between the step S1001 and the step S1005. In other words, the method 2000 further includes the steps S2001-S2003.

In step S2001, as shown in FIG. 2*a*, an edge detection is performed on the first subpixel and on the second subpixel respectively to determine whether an edge is presented. It is noted that the color of the first subpixel is the same as the color of the second subpixel, and the edge detection is performed on the subpixels with the red color, the blue color and the green color respectively. It is noted that the step S2001 is not limited to a sequence as shown in FIG. 2*a*. The step S2001 may be performed between the steps S1002 and S1003. The step S2001 may be performed between the steps S1003 and S1004. The step S2001 may be performed between the steps S1004 and S2002. In the followings, the red subpixels of the pixels of the image 10 are taken as an example to illustrate the edge detection. Referring to FIG. 1*c*, in this embodiment, the red subpixel 221 of the pixel 22 is taken as the first subpixel, and the red subpixel 231 of the pixel 23 adjacent to the pixel 22 is taken as the second subpixel. An operation of performing the edge detection on the first subpixel (i.e., the red subpixel 221) and on the second subpixel (i.e., the red subpixel 231) is described as follows.

First, plural gray level differences of the first subpixel (i.e., the red subpixel 221) of the first pixel (i.e., the pixel 22) are calculated. Each of the gray level differences of the first subpixel (i.e., the red subpixel 221) is a difference between a gray level of the first subpixel (i.e., the red subpixel 221) of the first pixel (i.e., the pixel 22) and each of the gray levels of plural third subpixels (i.e., the red subpixels 111, 211, 311, 121, and 321) of plural neighboring pixels (i.e., the pixels 11, 21, 31, 12 and 32) of the first pixel (i.e., the pixel 22). It is noted that the neighboring pixels of the first pixel (i.e., the pixel 22) mentioned above do not include the other pixels positioned in a next row of the first pixel (i.e., the pixel 22), such as the pixels 13, 23, and 33. Next, plural gray level differences of the second subpixel (i.e., the red subpixel 231) of a second pixel (i.e., the pixel 23) are calculated. Each of the gray level differences of the second subpixel (i.e., the red subpixel 231) is a difference between a gray level of the second subpixel (i.e., the red subpixel 231) of the second pixel (i.e., the pixel 23) and each of the gray levels of plural fourth subpixels (i.e., the red subpixels 121, 221, 321, 131, and 331) of plural neighboring pixels (i.e., the pixels 12, 22, 32, 13 and 33) of the second pixel (i.e., the pixel 23). It is noted that the neighboring pixels of the second pixel (i.e., the pixel 23) mentioned above do not include the other pixels positioned in a next row of the first pixel (i.e., the pixel 23). Then, it is determined that an edge is presented if either a greatest value of the gray level differences of the first subpixel is larger than or equal to an edge threshold of the first subpixel or a greatest value of the gray level differences of the second subpixel is larger than or equal to an edge threshold of the second subpixel. It is noted that the edge threshold of the first subpixel (i.e., the red subpixel 221) may be a fixed constant or a weight value of a greatest value of the gray levels of the first subpixel (i.e., the red subpixel 221) of the first pixel (i.e., the pixel 22) and the third subpixels (i.e., the red subpixels 111, 211, 311, 121, and 321) of the neighboring pixels (i.e., the pixel 11, 21, 31, 12 and 32) of the first pixel (i.e., the pixel 22). It is noted that the edge threshold of the second subpixel (i.e., the red subpixel 231) may be a fixed constant or a weight value of a greatest value of the gray levels of the second subpixel (i.e., the red subpixel 231) of the second pixel (i.e., the pixel 23) and the fourth subpixels (i.e., the red subpixels 121, 221, 321, 131, and 331) of the neighboring pixels (i.e., the pixel 12, 22, 32, 13 and 33) of the second pixel (i.e., the pixel 23).

In step S2002, as shown in FIG. 2*a*, it is determined whether the edge is presented. If the edge is present, the step S2003 is performed subsequently. In contrast, if the edge is not present, the step S1005 is performed subsequently.

In step S2003, as shown in FIG. 2*a*, an edge correction is performed on the higher subpixel and the lower subpixel. It is noted that the color of the higher subpixel is the same as the color of the lower subpixel. It is noted that the edge correction is performed on the subpixels with the red color, the blue color and the green color respectively. An operation of performing the edge correction on the higher subpixel and the lower subpixel is described as follows. The shifted gray level of the higher subpixel is decreased to obtain a decreased shifted gray level, and the shifted gray level of the lower subpixel is increased to obtain an increased shifted gray level. Then, the shifted gray level of the higher subpixel and the shifted gray level of the lower subpixel are replaced with the decreased shifted gray level and the increased shifted gray level, respectively. It is noted that the edge correction is configured to reduce a saw-tooth phenomenon occurred when the edge is presented.

A formula of decreasing the shifted gray level of the higher subpixel to obtain the decreased shifted gray level is as follows:

$$\text{decreased shifted gray level} = SGLH - \text{ROUND}\left(\frac{(SGLH - GLH) \times \text{H_LUT}(MAXH)}{1024}\right)$$

It is noted that a function of "ROUND" means to round up to a nearest integer, a function of "H_LUT" means to perform the lookup process according to the higher lookup table (as mentioned in step S1004), an input of "SGLH" means the shifted gray level of the higher subpixel, an input of "GLH" means the gray level of the higher subpixel. A higher pixel including the higher subpixel has plural neighboring pixels. Each of the neighboring pixels has plural subpixels. The neighboring pixels of the higher pixel do not include the other pixels positioned in the next row of the higher pixel. An input of "MAXH" means a greatest value of the gray levels of the higher subpixel and plural fifth subpixels of the subpixels of the neighboring pixels of the higher pixel. It is note that the color of the fifth subpixel is the same as the color of the higher subpixel.

A formula of increasing the shifted gray level of the lower subpixel to obtain the increased shifted gray level is as follows:

$$\text{increased shifted gray level} = SGLL + \text{ROUND}\left(\frac{(GLL - SGLL) \times \text{L_LUT}(MAXL)}{1024}\right)$$

It is noted that a function of "L_LUT" means to perform the lookup process according to the lower lookup table (as mentioned in step S1004), an input of "SGLL" means the shifted gray level of the lower subpixel, an input of "GLL" means the gray level of the lower subpixel. A lower pixel including the lower subpixel has plural neighboring pixels. Each of the neighboring pixels has plural subpixels. The neighboring pixels of the lower pixel do not include the other pixels positioned in the next row of the lower pixel. An input of "MARL" means a greatest value of the gray levels of the lower subpixel and plural sixth subpixels of the subpixels of the neighboring pixels of the lower pixel. It is note that the color of the sixth subpixel is the same as the color of the lower subpixel.

Figure 2B:
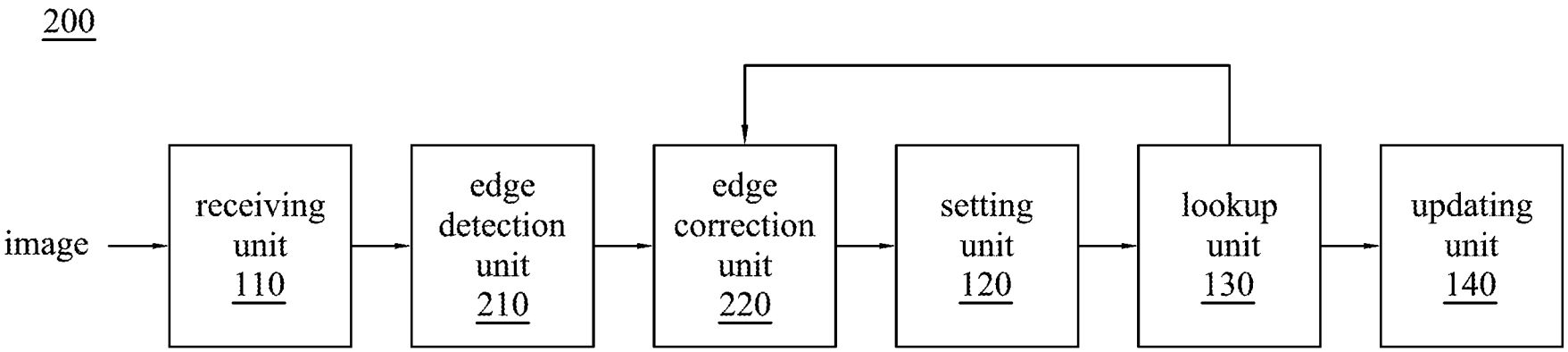
FIG. 2*b* is a block diagram showing a device for processing the image according to the second embodiment of the present invention.

FIG. 2*b* is a block diagram showing a device 200 for processing the image 10 according to the second embodiment of the present invention. The device 200 is similar to the device 100, but the device 200 further includes an edge detection unit 210 and an edge correction unit 220. The edge detection unit 210 is configured to perform the steps S2001 and S2002 of the method 2000. The edge correction unit 220 is configured to perform the step S2003 of the method 2000.

Figure 3A:
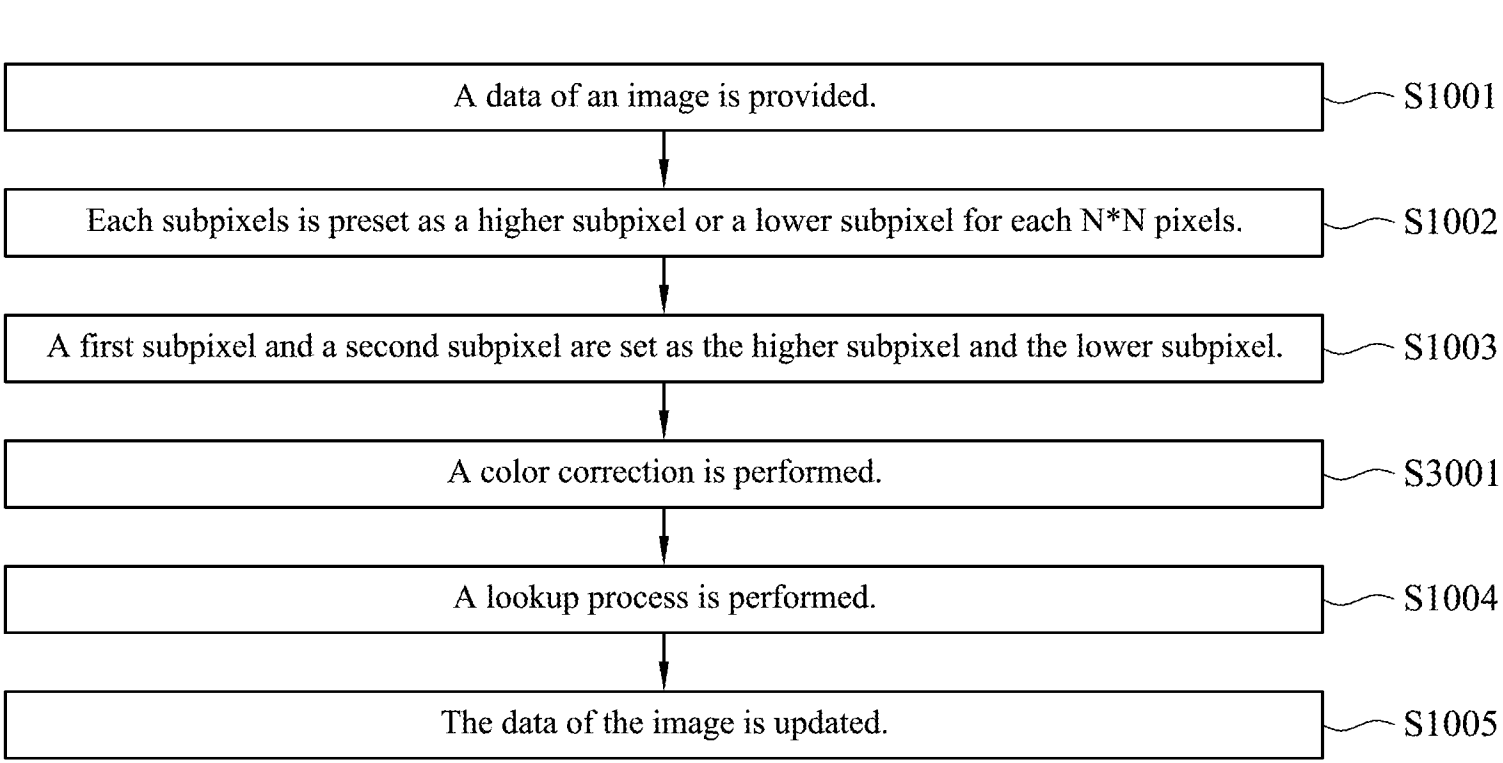
FIG. 3*a* is a flow chart showing a method for processing the image according to a third embodiment of the present invention.

FIG. 3*a* is a flow chart showing a method 3000 for processing the image 10 according to a third embodiment of the present invention. The method 3000 is similar to the method 1000 except a step S3001 is inserted between the step S1003 and the step S1004. In other words, the method 3000 further includes a step S3001.

In step S3001, as shown in FIG. 3*a*, a color correction is performed on the first subpixel and the second subpixel. It is noted that the color of the first subpixel is the same as the color of the second subpixel. It is noted that the color correction is performed on the subpixels with the red color, the blue color and the green color respectively. It is noted that the step S3001 is not limited to a sequence as shown in FIG. 3*a*. The step S3001 may be performed between the steps S1001 and S1002. The step S3001 may be performed between the steps S1002 and S1003. The step S3001 may be performed between the steps S1004 and S1005. In the followings, the red subpixels of the pixels are taken as an example to illustrate the color correction. Referring to FIG. 1*c*, in this embodiment, the red subpixel 221 of the pixel 22 is taken as the first subpixel, and the red subpixel 231 of the pixel 23 adjacent to the pixel 22 is taken as the second subpixel. An operation of performing the color correction is described as follows. First, plural color values of the first pixel (i.e., the pixel 22) including the red subpixel 221 are obtained by performing a color conversion based on the gray levels of the red subpixel 221 and the other subpixels (i.e., the green subpixel 222 and the blue subpixel 223) of the first pixel (i.e., the pixel 22), and plural color values of the second pixel (i.e., the pixel 23) including the red subpixel 231 are obtained by performing the color conversion based on gray levels of the red subpixel 231 and the other subpixels (i.e., the green subpixel 232 and the blue subpixel 233) of the second pixel (i.e., the pixel 23). It is noted that the color values may be the HSV (hue, saturation, and value) values, and thus the color conversion may be an RGB-to-HSV conversion. It is noted that the color values may the HSL (hue, saturation, and luminance) value, and thus the color conversion may be an RGB-to-HSL conversion. Next, a corrected gain of the first subpixel is determined according to a higher color lookup table based on the color values of the first pixel including the first subpixel, and a corrected gain of the second subpixel is determined according to a lower color lookup table based on the color values of the second pixel including the second subpixel. It is noted that the higher color lookup table and the lower color lookup table may be associated with the test pattern data. Finally, multiplying the gray level of the first subpixel by the corrected gain of the first subpixel to update the gray level of the first subpixel, and multiplying the gray level of the second subpixel by the corrected gain of the second subpixel to update the gray level of the second subpixel. It is noted that the color correction is configured to improve a color performance when displaying the image on a RGB display.

Figure 3B:
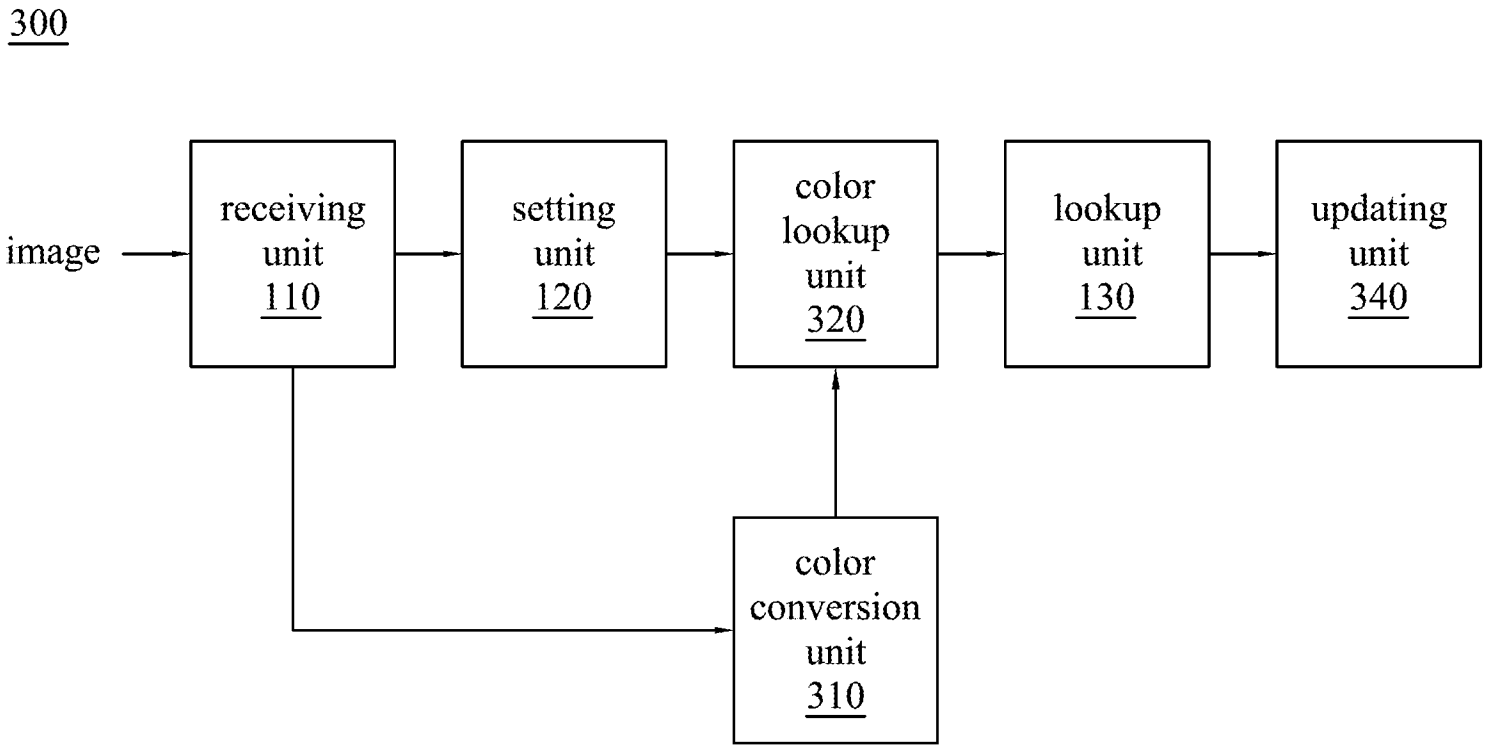
FIG. 3*b* is a block diagram showing a device for processing the image according to the third embodiment of the present invention.

FIG. 3*b* is a block diagram showing a device 300 for processing the image 10 according to the third embodiment of the present invention. The device 300 is similar to the device 100, but the device 300 further includes a color conversion unit 310, a color lookup unit 320, and an updating unit 340. The color conversion unit 310 is configured to perform the color conversion. The color lookup unit 320 is configured to determine the corrected gain of the first subpixel and the corrected gain of the second subpixel. The updating unit 340 is configured to perform the step S1005 of the method 3000 and further configured to multiply the gray level of the first subpixel by the corrected gain of the first subpixel and multiply the gray level of the second subpixel by the corrected gain of the second subpixel.

Figure 4A:
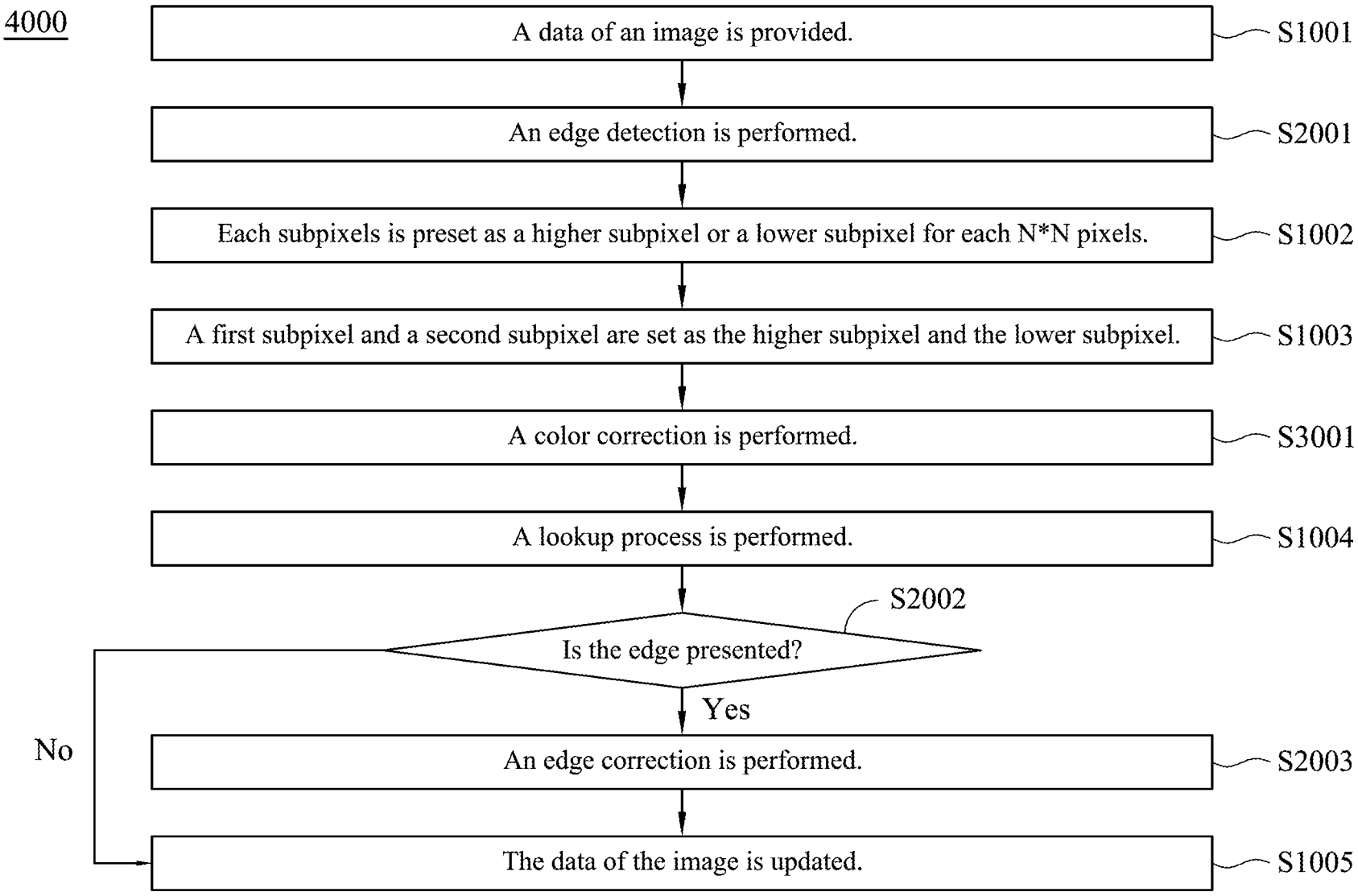
FIG. 4*a* is a flow chart showing a method for processing the image according to a fourth embodiment of the present invention.

FIG. 4*a* is a flow chart showing a method 4000 for processing the image 10 according to a fourth embodiment of the present invention. The method 4000 is similar to the method 2000 except the step S3001 is inserted between the step S1003 and the step S1004. It is noted that the step S3001 is not limited to a sequence as shown in FIG. 4*a*. The step S3001 may be performed between the steps S1001 and S2001. The step S3001 may be performed between the steps S2001 and S1002. The step S3001 may be performed between the steps S1002 and S1003. The step S3001 may be performed between the steps S1004 and S2002.

Figure 4B:
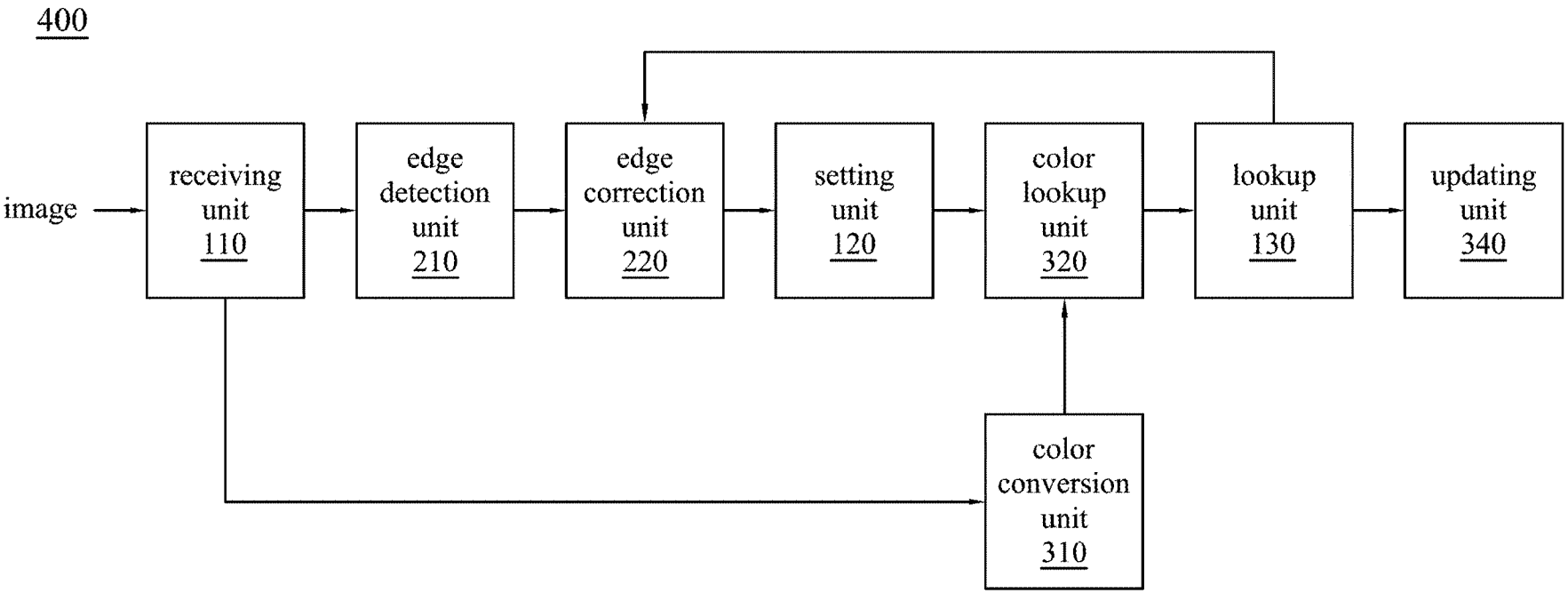
FIG. 4*b* is a block diagram showing a device for processing the image according to the fourth embodiment of the present invention.

FIG. 4*b* is a block diagram showing a device 400 for processing the image 10 according to the fourth embodiment of the present invention. The device 400 is similar to the device 300, but the device 400 further includes the edge detection unit 210 and the edge correction unit 220.

It is noted that the method and the device for processing the image of the present invention as mentioned above are not limited to be used for a RGB display. The method and the device for processing the image of the present invention may be used for a RGBW display. It is worth mentioning that the color shift problems of the RGBW display draw more attention than the RGB display.

Figure 5A:
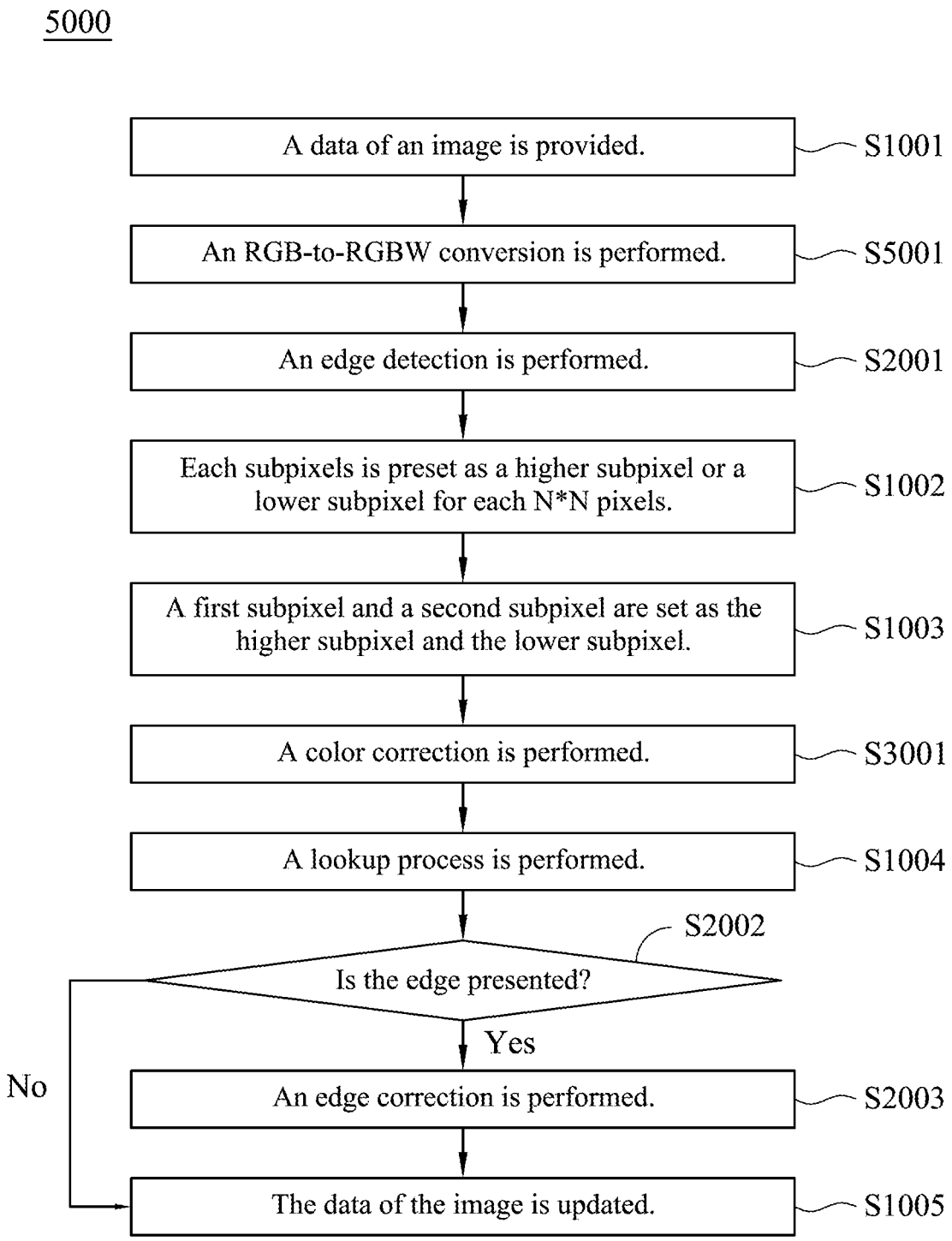
FIG. 5*a* is a flow chart showing a method for processing an image according to a fifth embodiment of the present invention.
Figure 5B:
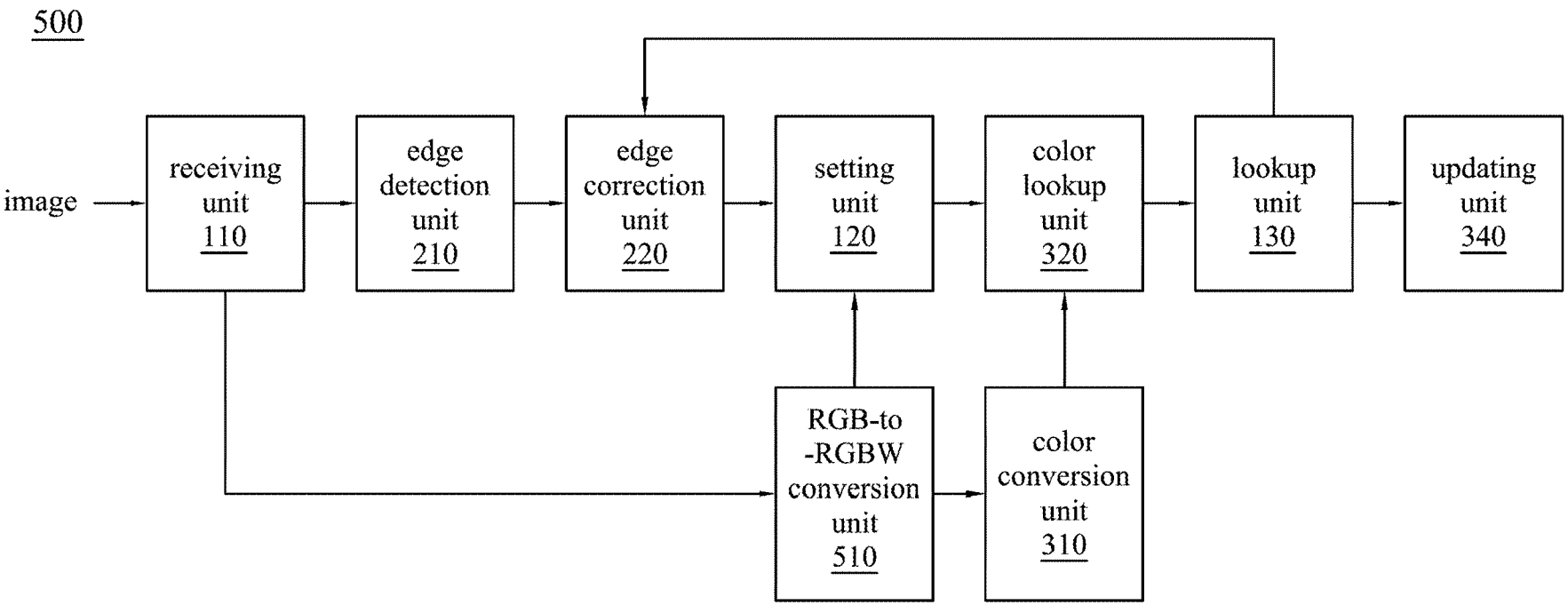
FIG. 5*b* is a block diagram showing a device for processing the image according to the fifth embodiment of the present invention.
Figure 5C:
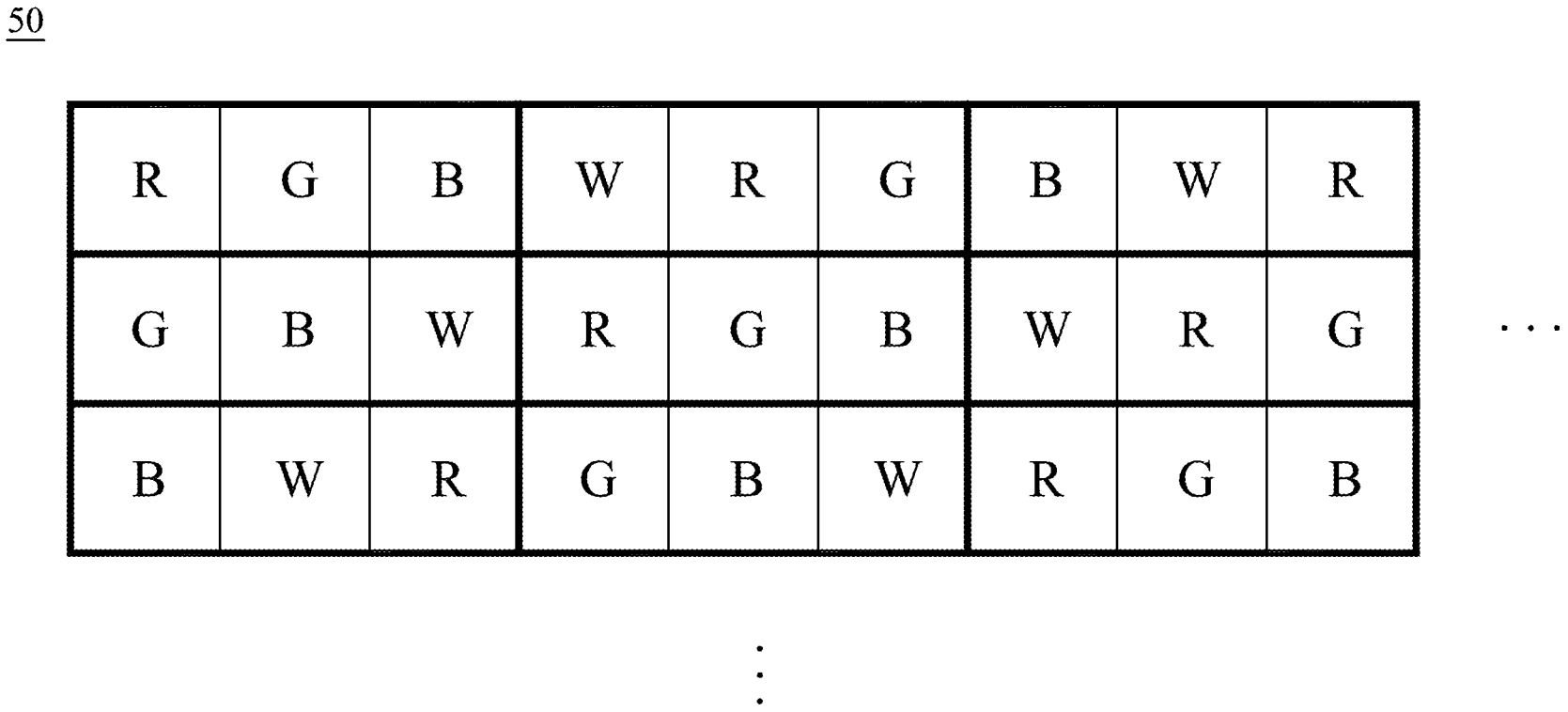
FIG. 5*c* is a schematic diagram showing a subpixel arrangement of the image according to a fifth embodiment of the present invention.

FIG. 5*c* is a schematic diagram showing a subpixel arrangement of an image 50 according to a fifth embodiment of the present invention. The image 50 includes plural pixels. Each of the pixels includes a red subpixel, a green subpixel, a blue subpixel, and a white subpixel. FIG. 5*a* is a flow chart showing a method 5000 for processing the image 50 according to the fifth embodiment of the present invention. The method 5000 is used for the RGBW display, the method 5000 is similar to the method 4000 except the step S5001 is inserted between the step S1001 and the step S2001. In step S5001, as shown in FIG. 5*a*, an RGB-to-RGBW conversion is performed. After the RGB-to-RGBW conversion is performed, a gray level of each of plural white subpixels is obtained. Therefore, the gray level of each of the white subpixels may be used for the subsequent steps.

FIG. 5*b* is a block diagram showing a device 500 for processing the image 50 according to the fifth embodiment of the present invention. The device 500 is similar to the device 400, but the device 500 further includes an RGB-to-RGBW conversion unit 510. The RGB-to-RGBW conversion unit 510 is configured to perform the RGB-to-RGBW conversion.

Figure 6A:
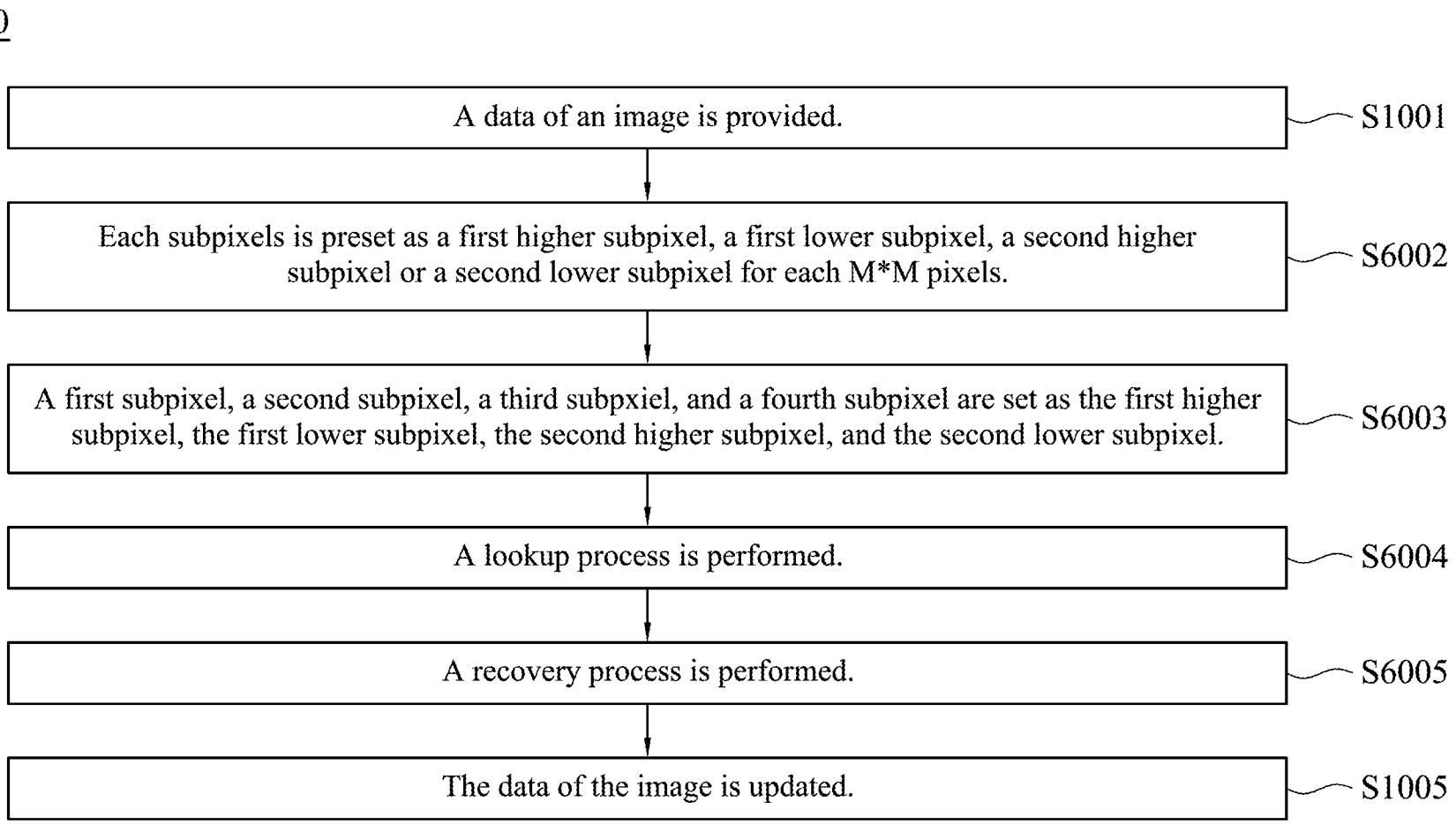
FIG. 6*a* is a flow chart showing a method for processing an image according to a sixth embodiment of the present invention.

FIG. 6*a* is a flow chart showing a method 6000 for processing an image 60 according to a sixth embodiment of the present invention. FIG. 6*c* is a schematic diagram showing a subpixel arrangement of the image 60 according to the sixth embodiment of the present invention. The image 60 includes plural pixels 61, 62, 71, 72, etc. Each of the pixels of the image 60 includes three subpixels, i.e., a red subpixel, a green subpixel, and a blue subpixel. For example, the pixel 61 includes the red subpixel 611, the green subpixel 612, and the blue subpixel 613, and so on. In addition, the data of the image 60 includes a gray level of each of the subpixels of each of the pixels of the image 60.

In step S1001, as shown in FIG. 6*a*, a data of the image 60 is provided. In step S6002, as shown in FIG. 6*a*, each subpixels of each of the pixels of the image 60 is preset as a first higher subpixel, a first lower subpixel, a second higher subpixel, or a second lower subpixel for each of M*M pixels. In the sixth embodiment of the present invention, M=8. In step S6003, as shown in FIG. 6*a*, a first subpixel, a second subpixel, a third subpixel, and a fourth subpixel are set as a first higher subpixel, a first lower subpixel, a second higher subpixel, and a second lower subpixel. It is noted that the first subpixel, the second subpixel, the third subpixel, and the fourth subpixel have the same color, therefore the first higher subpixel, the first lower subpixel, the second higher subpixel, and the second lower subpixel have the same color. It is noted that the setting of the first subpixel, the second subpixel, the third subpixel, and the fourth subpixel is performed on the subpixels with the red color, the blue color and the green color respectively.

In the followings, the red subpixels of the pixels are taken as an example to illustrate the setting of the first subpixel, the second subpixel, the third subpixel, and the fourth subpixel. Referring to FIG. 6*c*, in the sixth embodiment, the red subpixel 611 of the pixel 61 is taken as the first subpixel, the red subpixel 621 of the pixel 62 is taken as the second subpixel, the red subpixel 711 of the pixel 71 is taken as the third subpixel, and the red subpixel 721 of the pixel 72 is taken as the fourth subpixel. The first pixel (i.e., the pixel 61) including the first subpixel (i.e., the red subpixel 611) and the second pixel (i.e., the pixel 62) including the second subpixel (i.e., the red subpixel 621) are positioned at a first column in sequence. The third pixel (i.e., the pixel 71) including the third subpixel (i.e., the red subpixel 711) and the fourth pixel (i.e., the pixel 72) including the fourth subpixel (i.e., the red subpixel 721) are positioned at a second column in sequence. The first column is adjacent to the second column. The first pixel (i.e., the pixel 61) is adjacent to the third pixel (i.e., the pixel 71). As shown in FIG. 6*c*, the first subpixel (i.e., the red subpixel 611), the second subpixel (i.e., the red subpixel 621), the third subpixel (i.e., the red subpixel 711), and the fourth subpixel (i.e., the red subpixel 721) are set as the first higher subpixel (H1), the first lower subpixel (L1), the second lower subpixel (L2), and the second higher subpixel (H2), respectively.

In the followings, the green subpixels of the pixels are taken as an example to illustrate the setting of the first subpixel, the second subpixel, the third subpixel, and the fourth subpixel. Referring to FIG. 6*c*, in the sixth embodiment, the green subpixel 612 of the pixel 61 is taken as the first subpixel, the green subpixel 622 of the pixel 62 is taken as the second subpixel, the green subpixel 712 of the pixel 71 is taken as the third subpixel, and the green subpixel 722 of the pixel 72 is taken as the fourth subpixel. As shown in FIG. 6*c*, the first subpixel (i.e., the green subpixel 612), the second subpixel (i.e., the green subpixel 622), the third subpixel (i.e., the green subpixel 712), and the fourth subpixel (i.e., the green subpixel 722) are set as the first lower subpixel (L1), the first higher subpixel (H1), the second higher subpixel (H2), and the second lower subpixel (L2), respectively.

In step S6004, as shown in FIG. 6*a*, a lookup process is performed on the first higher subpixel and the first lower subpixel. It is noted that the lookup process is performed on the subpixels with the red color, the blue color and the green color respectively. An operation of performing the lookup process on the first higher subpixel and the first lower subpixel is described as follows. A shifted gray level of the first higher subpixel is determined according to a first higher lookup table (H1_LUT) based on a gray level of the first higher subpixel, and a shifted gray level of the first lower subpixel is determined according to a first lower lookup table (L1_LUT) based on a gray level of the first lower subpixel. It is noted that the H1_LUT and the L1_LUT may be associated with the test pattern data. It is noted that the lookup process is configured to let the gray levels of the first higher subpixel and the first lower subpixel to be converged to a standard gamma curve using a gamma value of 2.2, thereby reducing color shift when displaying the image on a RGB display.

In step S6005, as shown in FIG. 6*a*, a recovery process is performed on the second higher subpixel and the second lower subpixel. It is noted that the recovery process is performed on the subpixels with the red color, the blue color and the green color respectively. On the one hand, an operation of performing the recovery process on the second higher subpixel and the second lower subpixel is described as follows. A recovery lookup process is performed to determine a second higher gain value and a second lower gain value in accordance with the shifted gray level of the first higher subpixel and the shifted gray level of the first lower subpixel. Specifically, a second higher gain value is determined according to a second higher lookup table (H2_LUT) based on the shifted gray level of the first higher subpixel, and a second lower gain value is determined according to a second lower lookup table (L2_LUT) based on the shifted gray level of the first lower subpixel. A shifted gray level of the second higher subpixel may be a product of the shifted gray level of the first higher subpixel and the second higher gain value. A shifted gray level of the second lower subpixel may be a product of the shifted gray level of the first lower subpixel and the second lower gain value.

On the other hand, an operation of performing the recovery process on the second higher subpixel and the second lower subpixel is described as follows. A recovery lookup process is performed to determine a second higher difference value and a second lower difference value in accordance with the shifted gray level of the first higher subpixel and the shifted gray level of the first lower subpixel. Specifically, a second higher difference value is determined according to a second higher lookup table (H2_LUT) based on the shifted gray level of the first higher subpixel, and a second lower difference value is determined according to a second lower lookup table (L2_LUT) based on the shifted gray level of the first lower subpixel. A shifted gray level of the second higher subpixel may be a sum of the shifted gray level of the first higher subpixel and a second higher difference value. A shifted gray level of the second lower subpixel may be a sum of the shifted gray level of the first lower subpixel and a second lower difference value. It is noted that the recovery process is configured to let the gray levels of the second higher subpixel and the second lower subpixel to be converged to a standard gamma curve using a gamma value of 2.2, thereby reducing color shift when displaying the image on a RGB display.

In step S1005, as shown in FIG. 6*a*, the data of the image 60 is updated. The data of the image 60 is updated by replacing the gray level of the first higher subpixel with the shifted gray level of the first higher subpixel, replacing the gray level of the first lower subpixel with the shifted gray level of the first lower subpixel, replacing the gray level of the second higher subpixel with the shifted gray level of the second higher subpixel, and replacing the gray level of the second lower subpixel with the shifted gray level of the second lower subpixel. It is noted that all the subpixels of the pixels of the image 60 are processed by the steps S6002-S6005 and S1005. It is noted that the method 6000 can be also used for an image which has a tri-gate subpixel arrangement, as shown in FIG. 6*d*.

Figure 6B:
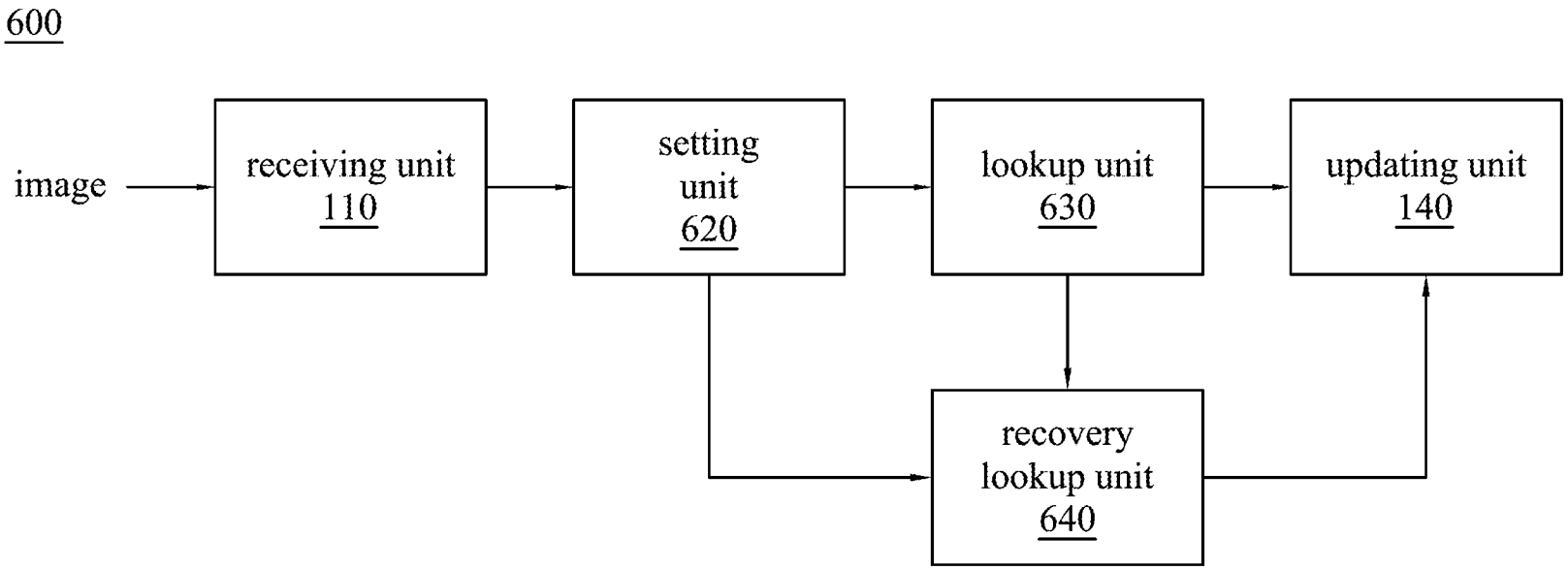
FIG. 6*b* is a block diagram showing a device for processing the image according to the sixth embodiment of the present invention.
Figure 6C:
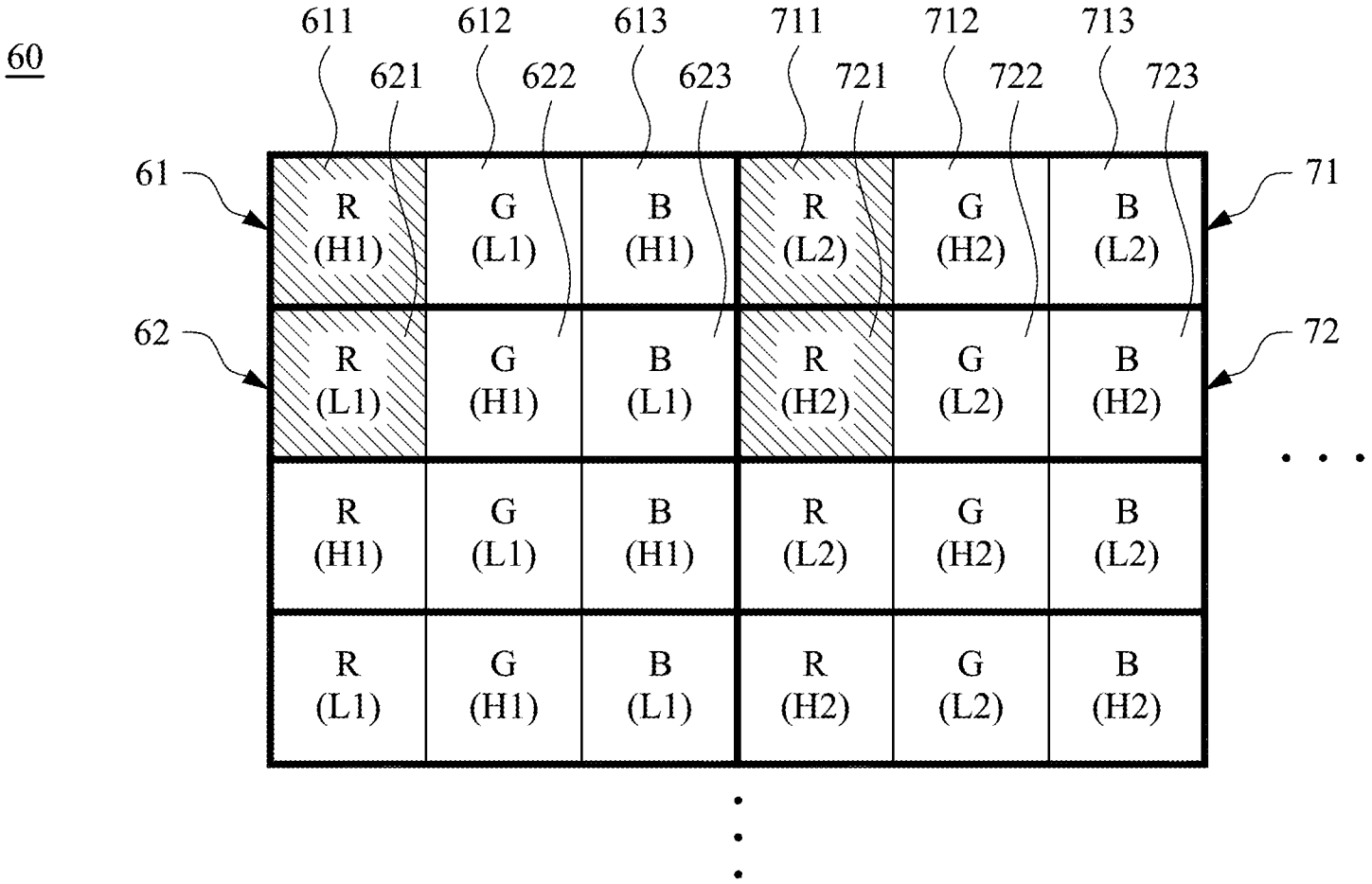
FIG. 6*c* is a schematic diagram showing a subpixel arrangement of the image according to the sixth embodiment of the present invention.

FIG. 6*b* is a block diagram showing a device 600 for processing the image 60 according to the sixth embodiment of the present invention. The device 600 includes the receiving unit 110, a setting unit 620, a lookup unit 630, a recovery lookup unit 640, and the updating unit 140. The receiving unit 110 is configured to receive the data of the image 60. The setting unit 620 is configured to perform the steps S6002 and S6003 of the method 6000. The lookup unit 630 is configured to perform the step S6004 of the method 6000. The recovery lookup unit 640 is configured to perform the step S6005 of the method 6000. The updating unit 140 is configured to perform the step S1005 of the method 6000.

Figure 7A:
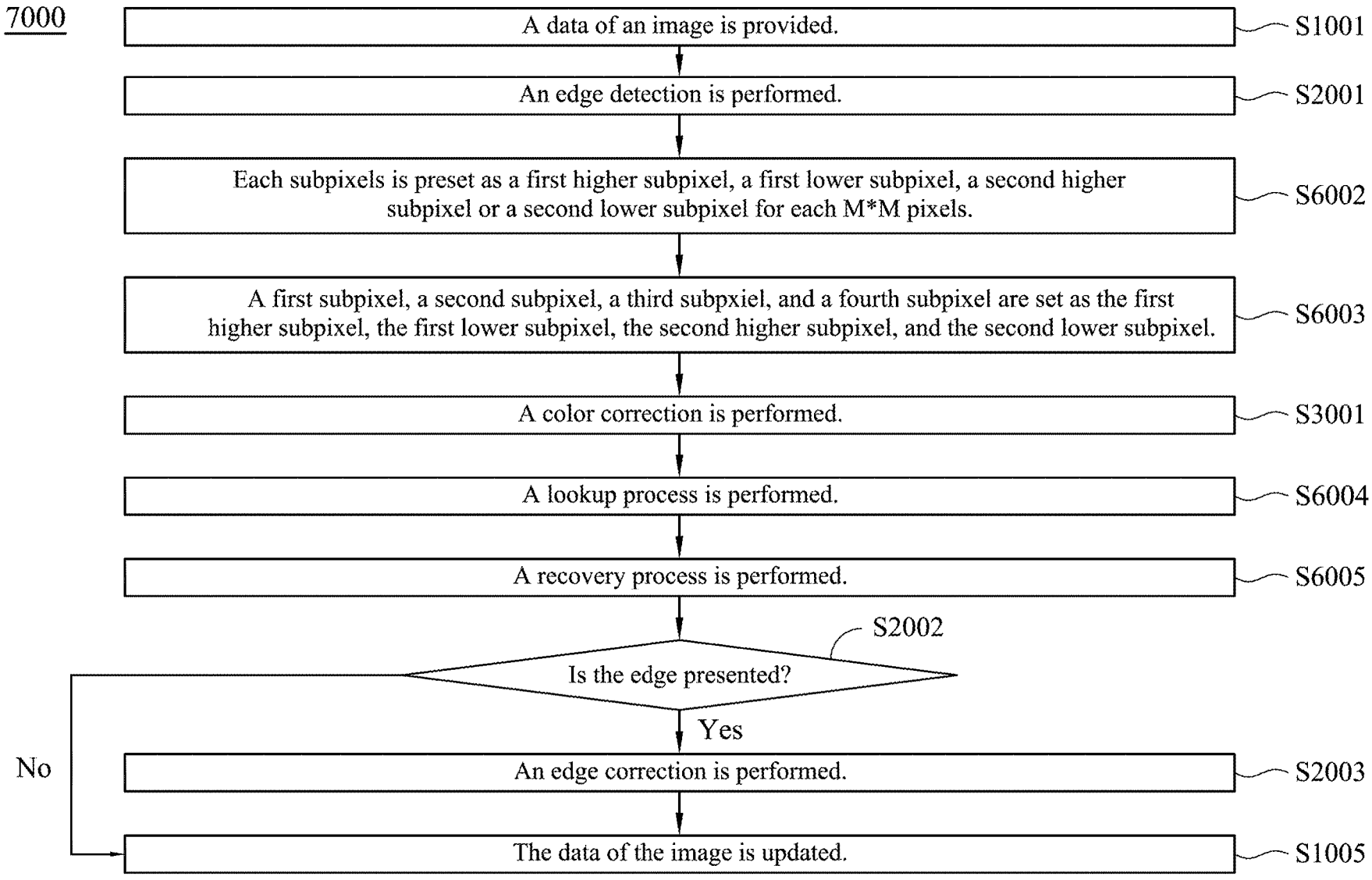
FIG. 7*a* is a flow chart showing a method for processing an image according to a seventh embodiment of the present invention.

FIG. 7*a* is a flow chart showing a method 7000 for processing the image 60 according to a seventh embodiment of the present invention. The method 7000 is similar to the method 6000 except plural steps S2001-S2003 and S3001 are inserted between the step S1001 and the step S1005. In other words, the method 7000 further includes the steps S2001-S2003 and S3001.

It is noted that the step S2001 is not limited to a sequence as shown in FIG. 7*a*. The step S2001 may be performed between the steps S6002 and S6003. The step S2001 may be performed between the steps S6003 and S6004. The step S2001 may be performed between the steps S6005 and S2002. An operation of steps S2001-S2003 of method 7000 is similar to the operation of the step S2001-S2003 of the method 2000 and is not repeated here to avoid duplicity. It is noted that the steps S2001, S2002, and S2003 of the method 7000 are configured to reduce a saw-tooth phenomenon occurred on the subpixels which are within the edge.

It is noted that the step S3001 is not limited to a sequence as shown in FIG. 7*a*. The step S3001 may be performed between the steps S1001 and S6002. The step S3001 may be performed between the steps S6002 and S6003. The step S3001 may be performed between the steps S6005 and S2002. The step S3001 may be performed between the steps S2003 and S1005. An operation of steps S3001 of method 7000 is similar to the operation of the step S3001 of the method 3000 and is not repeated here to avoid duplicity. It is noted that the step S3001 of the method 7000 is configured to improve a color performance when displaying the image on a RGB display.

Figure 7B:
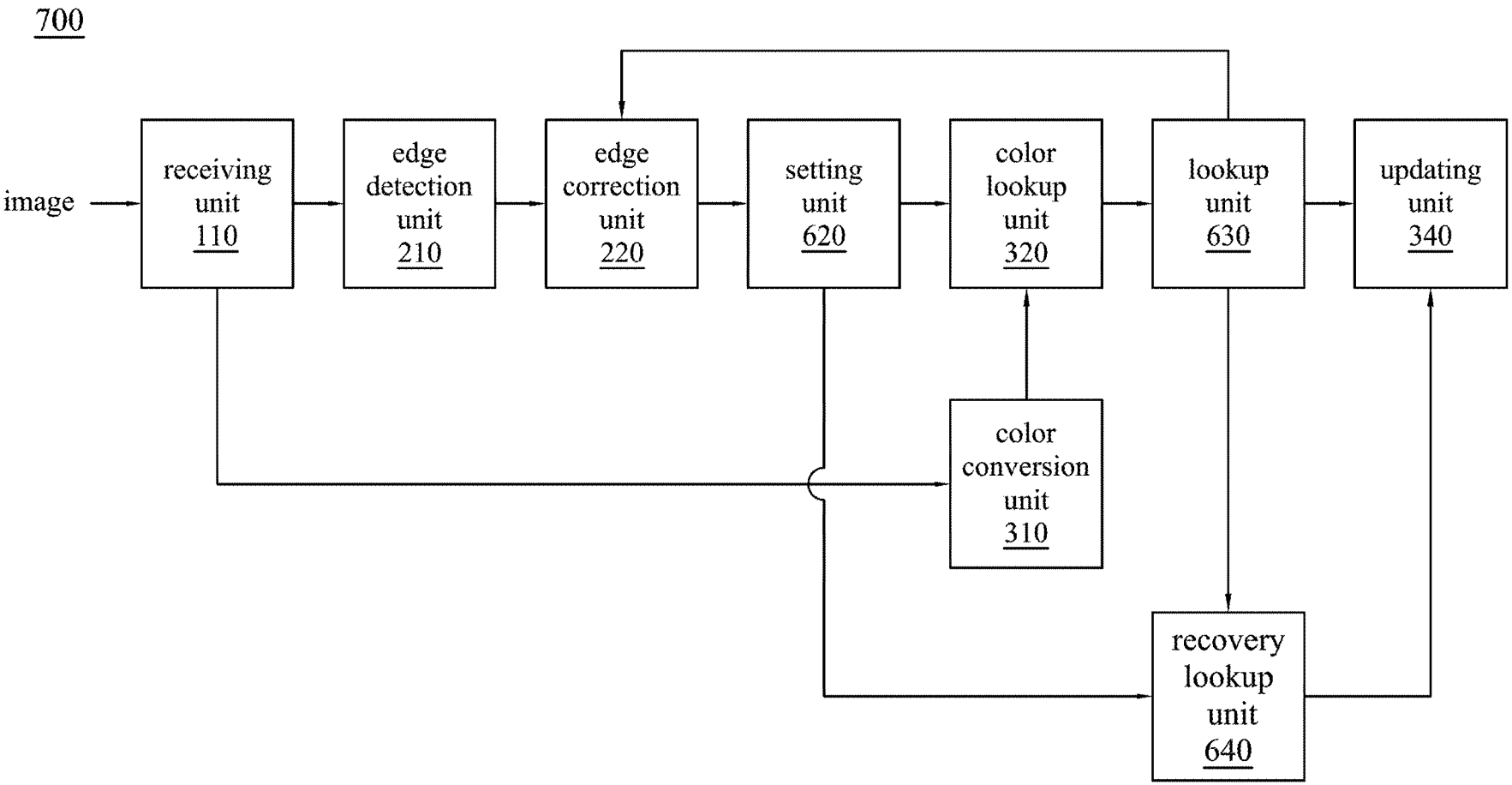
FIG. 7*b* is a block diagram showing a device for processing the image according to the seventh embodiment of the present invention.

FIG. 7*b* is a block diagram showing a device 700 for processing the image 60 according to the seventh embodiment of the present invention. The device 700 is similar to the device 600, but the device 700 further includes the edge detection unit 210, the edge correction unit 220, the color conversion unit 310, the color lookup unit 320, and the updating unit 340. The function of the updating unit 340 of the device 700 is similar to the updating unit 340 of the device 400 and is not repeated here to avoid duplicity. The edge detection unit 210 is configured to perform the steps S2001 and S2002 of the method 7000. The edge correction unit 220 is configured to perform the step S2003 of the method 7000. The color conversion unit 310 and the color lookup unit 320 are configured to perform the step S3001.

From the above description, the method and the device for processing the image of the present invention may be used for a RGB display or a RGBW display to effectively reduce the color shift problems of the RGB display or the RGBW display. The present invention further performs an edge correction thereby reducing a saw-tooth phenomenon occurred on the subpixels which are within the edge. The present invention further performs a color correction thereby improving a color performance of the display.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A method for processing an image, comprising:

providing a data of the image, wherein the image comprises a first pixel and a second pixel adjacent to each other, wherein each of the first pixel and the second pixel has a plurality of subpixels, wherein the data comprises a gray level of each of the subpixels;

setting a first subpixel of the subpixels of the first pixel and a second subpixel of the subpixels of the second pixel as a higher subpixel and a lower subpixel, wherein the color of the first subpixel is the same as the color of the second subpixel;

performing a lookup process to determine a shifted gray level of the higher subpixel and a shifted gray level of the lower subpixel in accordance with the gray level of the higher subpixel and the gray level of the lower subpixel respectively, wherein the shifted gray level of the higher subpixel is greater than the shifted gray level of the lower subpixel; and updating the gray level of the first subpixel and the gray level of the second subpixel in accordance with the shifted gray level of the higher subpixel and the shifted gray level of the lower subpixel;

wherein setting the first subpixel and the second subpixel as the higher subpixel and the lower subpixel comprises, calculating a gray-level difference which is a difference between the gray level of the first subpixel and the gray level of the second subpixel;

determining the first subpixel and the second subpixel as the higher subpixel and the lower subpixel if the gray-level difference is less than a difference threshold; and determining the first subpixel and the second subpixel as the lower subpixel and the higher subpixel if the gray-level difference is greater than or equal to the difference threshold.

2. The method of claim 1, further comprising:

performing an edge detection on the first subpixel and on the second subpixel respectively to determine whether an edge is presented;

decreasing the shifted gray level of the higher subpixel to obtain a decreased shifted gray level, and increasing the shifted gray level of the lower subpixel to obtain an increased shifted gray level, if the edge is presented; and replacing the shifted gray level of the higher subpixel and the shifted gray level of the lower subpixel with the decreased shifted gray level and the increased shifted gray level, respectively, before updating the gray level of the first subpixel and the gray level of the second subpixel, if the edge is presented.

3. The method of claim 2, wherein each of the first pixel and the second pixel has a plurality of neighboring pixels, wherein each of the neighboring pixels has a plurality of subpixels, and the neighboring pixels of the first pixel do not comprise the other pixels positioned in a next row of the first pixel, and the neighboring pixels of the second pixel do not comprise the other pixels positioned in a next row of the second pixel, wherein performing the edge detection on the first subpixel and on the second subpixel respectively to determine whether the edge is presented comprises:

calculating a gray level difference of the first subpixel which is a difference between the gray level of the first subpixel and a gray level of a third subpixel of the subpixels of the neighboring pixels of the first pixel, wherein the color of the third subpixel is the same as the color of the first subpixel;

calculating a gray level difference of the second subpixel which is the difference between the gray level of the second subpixel and a gray level of a fourth subpixel of the subpixels of the neighboring pixels of the second pixel, wherein the color of the fourth subpixel is the same as the color of the second subpixel; and determining the edge is presented if either a greatest value of the gray level differences of the first subpixel is larger than or equal to an edge threshold or a greatest value of the gray level differences of the second subpixel is larger than or equal to the edge threshold.

4. The method of claim 2, wherein a formula of decreasing the shifted gray level of the higher subpixel to obtain the decreased shifted gray level is as follows:

decreased shifted gray level =

$$SGLH - \mathrm{ROUND}\left(\frac{(SGLH - GLH) \times LUT(MAXH)}{1024}\right);$$

wherein a function of "ROUND" means to round up to a nearest integer, wherein a function of "LUT" means to perform the lookup process, wherein an input of "SGLH" means the shifted gray level of the higher subpixel, wherein an input of "GLH" means the gray level of the higher subpixel, wherein a higher pixel comprising the higher subpixel has a plurality of neighboring pixels, wherein each of the neighboring pixels has a plurality of subpixels, and the neighboring pixels of the higher pixel do not comprise the other pixels positioned in a next row of the higher pixel, wherein an input of "MAXH" means a greatest value of the gray levels of the higher subpixel and each of a gray level of a fifth subpixel of the subpixels of the neighboring pixels of the higher pixel, wherein the color of the fifth subpixel is the same as the color of the higher subpixel.

5. The method of claim 2, wherein a formula of increasing the shifted gray level of the lower subpixel to obtain the increased shifted gray level is as follows:

increased shifted gray level =

$$SGLL + \mathrm{ROUND}\left(\frac{(GLL - SGLL) \times LUT(MAXL)}{1024}\right);$$

wherein a function of "ROUND" means to round up to a nearest integer, wherein a function of "LUT" means to perform the lookup process, wherein an input of "SGLL" means the shifted gray level of the lower subpixel, wherein an input of "GLL" means the gray level of the lower subpixel, wherein a lower pixel comprising the lower subpixel has a plurality of neighboring pixels, wherein each of the neighboring pixels has a plurality of subpixels, and the neighboring pixels of the lower pixel do not comprise the other pixels positioned in a next row of the lower pixel, wherein an input of "MAXL" means a greatest value of the gray levels of the lower subpixel and each of a gray level of a sixth subpixel of the subpixels of the neighboring pixels of the lower pixel, wherein the color of the sixth subpixel is the same as the color of the lower subpixel.

6. The method of claim 1, further comprising:

performing a color conversion to obtain a plurality of color values of the first pixel and a plurality of color values of the second pixel in accordance with the gray levels of the subpixels of the first pixel and the gray levels of the subpixels of the second pixel respectively;

performing a color lookup process to determine a corrected gain of the first subpixel and a corrected gain of the second subpixel in accordance with the color values of the first pixel and the color values of the second pixel respectively; and multiplying the gray level of the first subpixel by the corrected gain of the first subpixel, and multiplying the gray level of the second subpixel by the corrected gain of the second subpixel, before performing the lookup process.

7. The method of claim 6, wherein the color conversion is an RGB-to-HSV conversion or an RGB-to-HSL conversion.

8. The method of claim 1, wherein each of the first subpixel and the second subpixel is one of a red subpixel, a green subpixel, and a blue subpixel.

9. The method of claim 1, wherein each of the first subpixel and the second subpixel is one of a red subpixel, a green subpixel, a blue subpixel, and a white subpixel.

10. The method of claim 9, further comprising:

performing an RGB-to-RGBW conversion before setting the first subpixel and the second subpixel.

11. A device for processing an image, comprising:

a receiving circuit configured to receive a data of the image, wherein the image comprises a first pixel and a second pixel adjacent to each other, wherein each of the first pixel and the second pixel has a plurality of subpixels, wherein the data comprises a gray level of each of the subpixels;

a setting circuit configured to set a first subpixel of the subpixels of the first pixel and a second subpixel of the subpixels of the second pixel as a higher subpixel and a lower subpixel, wherein the color of the first subpixel is the same as the color of the second subpixel;

a lookup circuit configured to perform a lookup process to determine a shifted gray level of the higher subpixel and a shifted gray level of the lower subpixel in accordance with the gray level of the higher subpixel and the gray level of the lower subpixel respectively, wherein the shifted gray level of the higher subpixel is greater than the shifted gray level of the lower subpixel; and an updating circuit configured to update the gray level of the first subpixel and the gray level of the second subpixel in accordance with the shifted gray level of the higher subpixel and the shifted gray level of the lower subpixel;

wherein the setting circuit is configured to perform the following steps:

calculating a gray-level difference which is a difference between the gray level of the first subpixel and the gray level of the second subpixel;

determining the first subpixel and the second subpixel as the higher subpixel and the lower subpixel if either the gray-level difference is less than a difference threshold or the gray level of the first subpixel is greater than or equal to the gray level of the second subpixel; and determining the first subpixel and the second subpixel as the lower subpixel and the higher subpixel if the gray-level difference is greater than or equal to the difference threshold and the gray level of the first subpixel is less than the gray level of the second subpixel.

12. The device of claim 11, further comprising:

an edge detection circuit configured to perform an edge detection on the first subpixel and on the second subpixel respectively to determine whether an edge is presented;

an edge correction circuit configured to decrease the shifted gray level of the higher subpixel to obtain a decreased shifted gray level and to increase the shifted gray level of the lower subpixel to obtain an increased shifted gray level, and to replace the shifted gray level of the higher subpixel and the shifted gray level of the lower subpixel with the decreased shifted gray level and the increased shifted gray level before updating the gray level of the first subpixel and the gray level of the second subpixel, respectively, if the edge is presented.

13. The device of claim 12, wherein each of the first pixel and the second pixel has a plurality of neighboring pixels, wherein each of the neighboring pixels has a plurality of subpixels, and the neighboring pixels of the first pixel do not comprise the other pixels positioned in a next row of the first pixel, and the neighboring pixels of the second pixel do not comprise the other pixels positioned in the next row of the second pixel, wherein the edge detection circuit is configured to perform the following steps:

calculating a gray level difference of the first subpixel which is a difference between the gray level of the first subpixel and a gray level of a third subpixel of the subpixels of the neighboring pixels of the first pixel, wherein the color of the third subpixel is the same as the color of the first subpixel;

calculating a gray level difference of the second subpixel which is the difference between the gray level of the second subpixel and a gray level of a fourth subpixel of the subpixels of the neighboring pixels of the second pixel, wherein the color of the fourth subpixel is the same as the color of the second subpixel; and determining the edge is presented if either a greatest value of the gray level differences of the first subpixel is larger than or equal to an edge threshold or a greatest value of the gray level differences of the second subpixel is larger than or equal to the edge threshold.

14. The device of claim 12, wherein a formula of decreasing the shifted gray level of the higher subpixel to obtain the decreased shifted gray level is as follows:

$$\text{decreased shifted gray level} = SGLH - \text{ROUND}\left(\frac{(SGLH - GLH) \times LUT(MAXH)}{1024}\right);$$

wherein a function of "ROUND" means to round up to a nearest integer, wherein a function of "LUT" means to perform the lookup process, wherein an input of "SGLH" means the shifted gray level of the higher subpixel, wherein an input of "GLH" means the gray level of the higher subpixel, wherein a higher pixel comprising the higher subpixel has a plurality of neighboring pixels, wherein each of the neighboring pixels has a plurality of subpixels, and the neighboring pixels of the higher pixel do not comprise the other pixels positioned in a next row of the higher pixel, wherein an input of "MAXH" means a greatest value of the gray levels of the higher subpixel and each of a gray level of a fifth subpixel of the subpixels of the neighboring pixels of the higher pixel, wherein the color of the fifth subpixel is the same as the color of the higher subpixel.

15. The device of claim 14, wherein a formula of increasing the shifted gray level of the lower subpixel to obtain the increased shifted gray level is as follows:

$$\text{increased shifted gray level} = SGLL + \text{ROUND}\left(\frac{(GLL - SGLL) \times LUT(MAXL)}{1024}\right);$$

wherein a function of "ROUND" means to round up to a nearest integer, wherein a function of "LUT" means to perform the lookup process, wherein an input of "SGLL" means the shifted gray level of the lower subpixel, wherein an input of "GLL" means the gray level of the lower subpixel, wherein a lower pixel comprising the lower subpixel has a plurality of neighboring pixels, wherein each of the neighboring pixels has a plurality of subpixels, and the neighboring pixels of the lower pixel do not comprise the other pixels positioned in a next row of the lower pixel, wherein an input of "MAXL" means a greatest value of the gray levels of the lower subpixel and each of a gray level of a sixth subpixel of the subpixels of the neighboring pixels of the lower pixel, wherein the color of the sixth subpixel is the same as the color of the lower subpixel.

16. The device of claim 11, further comprising:

a color conversion circuit configured to perform a color conversion to obtain a plurality of color values of the first pixel and a plurality of color values of the second pixel in accordance with the gray levels of the subpixels of the first pixel and the gray levels of the subpixels of the second pixel respectively;

a color lookup circuit configured to perform a color lookup process to determine a corrected gain of the first subpixel and a corrected gain of the second subpixel in accordance with the color values of the first pixel and the color values of the second pixel respectively; and wherein the updating circuit is further configured to multiply the gray level of the first subpixel by the corrected gain of the first subpixel and to multiply the gray level of the second subpixel by the corrected gain of the second subpixel, before performing the lookup process.

17. The device of claim 16, wherein the color conversion is an RGB-to-HSV conversion or an RGB-to-HSL conversion.

18. The device of claim 11, wherein each of the first subpixel and the second subpixel is one of a red subpixel, a green subpixel, and a blue subpixel.

19. The device of claim 11, wherein each of the first subpixel and the second subpixel is one of a red subpixel, a green subpixel, a blue subpixel, and a white subpixel.

20. The device of claim 19, further comprising:

an RGB-to-RGBW conversion circuit configured to perform an RGB-to-RGBW conversion before setting the first subpixel and the second subpixel.

21. A method for processing an image, comprising:

providing a data of the image, wherein the image comprises a plurality of pixels, wherein each of the pixels has a plurality of subpixels, the data comprises a gray level of each of the subpixels, wherein the pixels comprise a first pixel and a second pixel positioned at a first column in sequence, wherein the pixels further comprise a third pixel and a fourth pixel positioned at a second column in sequence, wherein the first column is adjacent to the second column, wherein the first pixel is adjacent to the third pixel;

setting a first subpixel of the subpixels of the first pixel, a second subpixel of the subpixels of the second pixel, a third subpixel of the subpixels of the third pixel, and a fourth subpixel of the subpixels of the fourth pixel as a first higher subpixel, a first lower subpixel, a second higher subpixel, and a second lower subpixel, wherein the first subpixel, the second subpixel, the third subpixel, and the fourth subpixel have the same color;

performing a lookup process to determine a shifted gray level of the first higher subpixel and a shifted gray level of the first lower subpixel in accordance with the gray level of the first higher subpixel and the gray level of the first lower subpixel, respectively;

performing a recovery process to determine a shifted gray level of the second higher subpixel and a shifted gray level of the second lower subpixel in accordance with the shifted gray level of the first higher subpixel and the shifted gray level of the first lower subpixel, respectively; and updating the gray level of the first subpixel, the gray level of the second subpixel, the gray level of the third subpixel, and the gray level of the fourth subpixel in accordance with the shifted gray level of the first subpixel, the shifted gray level of the second subpixel, the shifted gray level of the third subpixel, and the shifted gray level of the fourth subpixel, respectively.

22. The method of claim 21, wherein performing the recovery process comprises:

performing a recovery lookup process to determine a second higher gain value and a second lower gain value in accordance with the shifted gray level of the first higher subpixel and the shifted gray level of the first lower subpixel, respectively;

multiplying the shifted gray level of the first higher subpixel by the second higher gain value to determine the shifted gray level of the second higher subpixel; and multiplying the shifted gray level of the first lower subpixel by the second lower gain value to determine the shifted gray level of the second lower subpixel.

23. The method of claim 21, wherein performing the recovery process comprises:

performing a recovery lookup process to determine a second higher difference value and a second lower difference value in accordance with the shifted gray level of the first higher subpixel and the shifted gray level of the first lower subpixel, respectively;

adding the second higher difference value to the shifted gray level of the first higher subpixel to determine the shifted gray level of the second higher subpixel; and adding second lower difference value to the shifted gray level of the first lower subpixel to determine the shifted gray level of the second lower subpixel.

24. The method of claim 21, wherein setting the first subpixel, the second subpixel, the third subpixel, and the fourth subpixel as the first higher subpixel, the first lower subpixel, the second higher subpixel, and the second lower subpixel comprises:

setting the first subpixel as the first higher subpixel;

setting the second subpixel as the first lower subpixel;

setting the third subpixel as the second lower subpixel; and setting the fourth subpixel as the second higher subpixel.

25. The method of claim 21, wherein setting the first subpixel, the second subpixel, the third subpixel, and the fourth subpixel as the first higher subpixel, the first lower subpixel, the second higher subpixel, and the second lower subpixel comprises:

setting the first subpixel as the first lower subpixel;

setting the second subpixel as the first higher subpixel;

setting the third subpixel as the second higher subpixel; and setting the fourth subpixel as the second lower subpixel.

26. The method of claim 21, wherein each of the first subpixel, the second subpixel, the third subpixel, and the fourth subpixel is one of a red subpixel, a green subpixel, and a blue subpixel.

27. A device for processing an image, comprising:

a receiving circuit configured to receive a data of the image, wherein the image comprises a plurality of pixels, wherein each of the pixels has a plurality of subpixels, the data comprises a gray level of each of the subpixels, wherein the pixels comprise a first pixel and a second pixel positioned at a first column in sequence, wherein the pixels further comprise a third pixel and a fourth pixel positioned at a second column in sequence, wherein the first column is adjacent to the second column, wherein the first pixel is adjacent to the third pixel;

a setting circuit configured to set a first subpixel of the subpixels of the first pixel, a second subpixel of the subpixels of the second pixel, a third subpixel of the subpixels of the third pixel, and a fourth subpixel of the subpixels of the fourth pixel as a first higher subpixel, a first lower subpixel, a second higher subpixel, and a second lower subpixel, wherein the first subpixel, the second subpixel, the third subpixel, and the fourth subpixel have the same color;

a lookup circuit configured to perform a lookup process to determine a shifted gray level of the first higher subpixel and a shifted gray level of the first lower subpixel in accordance with the gray level of the first higher subpixel and the gray level of the first lower subpixel, respectively;

a recovery lookup circuit configured to perform a recovery process to determine a shifted gray level of the second higher subpixel and a shifted gray level of the second lower subpixel in accordance with the shifted gray level of the first higher subpixel and the shifted gray level of the first lower subpixel, respectively; and an updating circuit configured to update the gray level of the first subpixel, the gray level of the second subpixel, the gray level of the third subpixel, and the gray level of the fourth subpixel in accordance with the shifted gray level of the first subpixel, the shifted gray level of the second subpixel, the shifted gray level of the third subpixel, and the shifted gray level of the fourth subpixel, respectively.

28. The device of claim 27, performing the recovery process comprises:

performing a recovery lookup process to determine a second higher gain value and a second lower gain value in accordance with the shifted gray level of the first higher subpixel and the shifted gray level of the first lower subpixel, respectively;

multiplying the shifted gray level of the first higher subpixel by the second higher gain value to determine the shifted gray level of the second higher subpixel; and multiplying the shifted gray level of the first lower subpixel by the second lower gain value to determine the shifted gray level of the second lower subpixel.

29. The device of claim 27, performing the recovery process comprises:

performing a recovery lookup process to determine a second higher difference value and a second lower difference value in accordance with the shifted gray level of the first higher subpixel and the shifted gray level of the first lower subpixel, respectively;

adding the second higher difference value to the shifted gray level of the first higher subpixel to determine the shifted gray level of the second higher subpixel; and adding the second lower difference value to the shifted gray level of the first lower subpixel to determine the shifted gray level of the second lower subpixel.

30. The device of claim 27, wherein the setting circuit is configured to perform the following steps:

setting the first subpixel as the first higher subpixel;

setting the second subpixel as the first lower subpixel;

setting the third subpixel as the second lower subpixel; and setting the fourth subpixel as the second higher subpixel.

31. The device of claim 27, wherein the setting circuit is configured to perform the following steps:

setting the first subpixel as the first lower subpixel;

setting the second subpixel as the first higher subpixel;

setting the third subpixel as the second higher subpixel; and setting the fourth subpixel as the second lower subpixel.

32. The device of claim 27, wherein each of the first subpixel, the second subpixel, the third subpixel, and the fourth subpixel is one of a red subpixel, a green subpixel, and a blue subpixel.

* * * * *